US010576775B2

(12) United States Patent
Namiki et al.

(10) Patent No.: US 10,576,775 B2
(45) Date of Patent: Mar. 3, 2020

(54) KNOCK TYPE WRITING INSTRUMENT

(71) Applicant: MITSUBISHI PENCIL COMPANY, LIMITED, Tokyo (JP)

(72) Inventors: Yoshiharu Namiki, Yokohama (JP); Kazuhiko Furukawa, Yokohama (JP); Yusuke Nakamura, Yokohama (JP); Kazuhiko Takanashi, Tokyo (JP); Atsushi Nakashima, Yokohama (JP); Yoshihiro Manta, Yokohama (JP)

(73) Assignee: Mitsubishi Pencil Company, Limited, Tokyo (JP)

( * ) Notice: Subject to any disclaimer, the term of this patent is extended or adjusted under 35 U.S.C. 154(b) by 0 days.

(21) Appl. No.: 15/777,315

(22) PCT Filed: Dec. 9, 2015

(86) PCT No.: PCT/JP2015/084566
§ 371 (c)(1),
(2) Date: May 18, 2018

(87) PCT Pub. No.: WO2017/098612
PCT Pub. Date: Jun. 15, 2017

(65) Prior Publication Data

US 2018/0333980 A1 Nov. 22, 2018

(51) Int. Cl.
*B43K 7/12* (2006.01)
*B43K 29/02* (2006.01)
(Continued)

(52) U.S. Cl.
CPC ..... *B43K 7/12* (2013.01); *B43K 11/00* (2013.01); *B43K 24/08* (2013.01); *B43K 29/02* (2013.01); *B43K 25/02* (2013.01)

(58) Field of Classification Search
CPC ..... B43K 21/006; B43K 21/02; B43K 21/16; B43K 21/22; B43K 24/03; B43K 24/08; B43K 24/084
(Continued)

(56) References Cited

U.S. PATENT DOCUMENTS 378,897 A 3/1888 Myers
5,688,063 A * 11/1997 Yu ..... B43K 8/22 401/109
(Continued)

FOREIGN PATENT DOCUMENTS

GB 1264963 A 2/1972
GB 2381243 A 4/2003
(Continued)

*Primary Examiner* — David P Angwin
*Assistant Examiner* — Bradley S Oliver
(74) *Attorney, Agent, or Firm* — Foley & Lardner LLP

(57) ABSTRACT

Provided is a knock type writing instrument provided with a simple mechanism allowing a stable fretting operation or the like. A knock type writing instrument 1 is provided with: a shaft cylinder 2; a refill 5 arranged inside the shaft cylinder 2; a spring 6 biasing the refill 5 backward; an operation part 20 pressed forward against a biasing force of the spring 6 in a knocking operation; and a main rotor 30, and is switchable between a writing state and a non-writing state with the knocking operation. The knock type writing instrument 1 is further provided with: a knock locking member 50 movable forward and backward inside the shaft cylinder 2 due to gravity; and a locking part 60 provided on a side of the shaft cylinder 2 and capable of being locked with the knock locking member 50. When a front end of the shaft cylinder 2 is directed upward, the knock locking member 50 moves backward to be locked with the locking part 60 to prevent forward movement of the operation part 20.

7 Claims, 34 Drawing Sheets

(51) Int. Cl.

| | |
|---|---|
| ***B43K 24/08*** | (2006.01) |
| ***B43K 11/00*** | (2006.01) |
| ***B43K 25/02*** | (2006.01) |

(58) Field of Classification Search
USPC ..... 401/112
See application file for complete search history.

(56) References Cited

U.S. PATENT DOCUMENTS

| | | | | |
|---|---|---|---|---|
| 7,972,072 | B2 * | 7/2011 | Toyama | B43K 24/084 401/109 |
| 8,292,530 | B2 * | 10/2012 | Tamano | B43K 7/005 401/105 |
| 9,914,322 | B2 * | 3/2018 | Soejima | B43K 21/04 |
| 10,017,004 | B2 * | 7/2018 | Kim | B43K 29/02 |
| 2010/0150638 | A1 * | 6/2010 | Namiki | B43K 7/12 401/99 |
| 2014/0331448 | A1 * | 11/2014 | Ohtsuka | B43K 7/02 15/425 |

FOREIGN PATENT DOCUMENTS

| | | | |
|---|---|---|---|
| JP | 07-017585 | U | 3/1995 |
| JP | 2002-307892 | A | 10/2002 |
| JP | 2009-45825 | A | 3/2009 |
| JP | 2009-255427 | A | 11/2009 |
| JP | 2011-037087 | A | 2/2011 |
| JP | 2012-106356 | A | 6/2012 |
| JP | 2014-097633 | A | 5/2014 |
| JP | 2015-020282 | A | 2/2015 |

* cited by examiner

KNOCK TYPE WRITING INSTRUMENT

CROSS-REFERENCE TO RELATED APPLICATION

This application is a National Stage application of PCT/JP2015/084566, filed Dec. 9, 2015.

FIELD

The present invention relates to a knock type writing instrument.

BACKGROUND

Known in the art is a so-called "knock type writing instrument" which has an operating part at a back end part of a barrel and in which a knock operation pushing the operating part against a biasing force of a spring arranged inside the barrel is used to cause the instrument to switch to a writing state where a writing part constituted by a tip of a refill holding ink, that is, a writing member, projects out from a front end of the barrel and in which a repeat knock operation or depression of a release part separate from the operating part is used to cause the instrument to switch to a nonwriting state where the writing part is retracted inside the barrel.

SUMMARY

Technical Problem

For example, in the knock type writing instrument described in Japanese Patent Publication No. 2011-37087A, the operating part also acts as a rubbing member for rubbing against thermochromic ink of the knock type writing instrument. Therefore, at the time of a rubbing operation, for a stable rubbing operation, the operating part has to be rotated in the circumferential direction to prevent movement in the front-back direction. Such an operation is troublesome.

The present invention has as its object the provision of a knock type writing instrument provided with a simple mechanism enabling a stable rubbing operation etc.

Solution to Problem

According to one aspect of the present invention, there is provided a knock type writing instrument comprising a barrel, a writing member arranged inside the barrel, an elastic member biasing the writing member backward, an operating part which is pushed forward against a biasing force of the elastic member at the time of a knock operation, and an engaging member and performing a knock operation enabling a writing state and a nonwriting state to be switched, which knock type writing instrument further comprises a knock lock member able to move inside the barrel in a front-back direction by gravity and a locking part provided at the barrel side and able to lock with the knock lock member, when a front end of the barrel is turned upward, the knock lock member moving backward to lock with the locking part whereby movement of the operating part forward is obstructed. Note that, in an axial direction of the knock type writing instrument, a writing part side is defined as a "front" side and a side opposite to the writing part is defined as a "back" side.

Further, according to another aspect, the knock type writing instrument is switched between the writing state and nonwriting state by the engaging member being engaged with or disengaged from an engaging part provided at the barrel side, and the instrument further comprises a speed reducing rotor moving in a front-back direction together with the writing member and a first cam face making the speed reducing rotor rotate about a center axis in cooperation with the speed reducing rotor while the writing member is moving backward.

Further, according to another aspect, an outer surface of the writing member is provided with a braking part braking the writing member in cooperation with the barrel when the writing member is retracted by a knock operation.

Further, according to another aspect, the elastic member is a coil spring with at least one of a pitch, outside diameter, and wire size which is not uniform.

Further, according to another aspect, the operating part has an erasing member, the erasing member is triangular shaped in transverse cross-section exposed at a back end, a vertex of the triangular shape is formed in a round arc shape, and a radius of curvature of that arc is greater at the back end side.

Further, according to another aspect, the knock type writing instrument is a knock type writing instrument having thermochromic ink, the operating part has an erasing member, and heat of friction generated when using the erasing member to rub a surface enabling writing by the thermochromic ink to be changed in color by heat.

Advantageous Effects of Invention

According to the aspects of the present invention, the common effect is exhibited of providing a knock type writing instrument provided with a simple mechanism enabling a stable rubbing operation etc.

DESCRIPTION OF EMBODIMENTS

Figure 1:
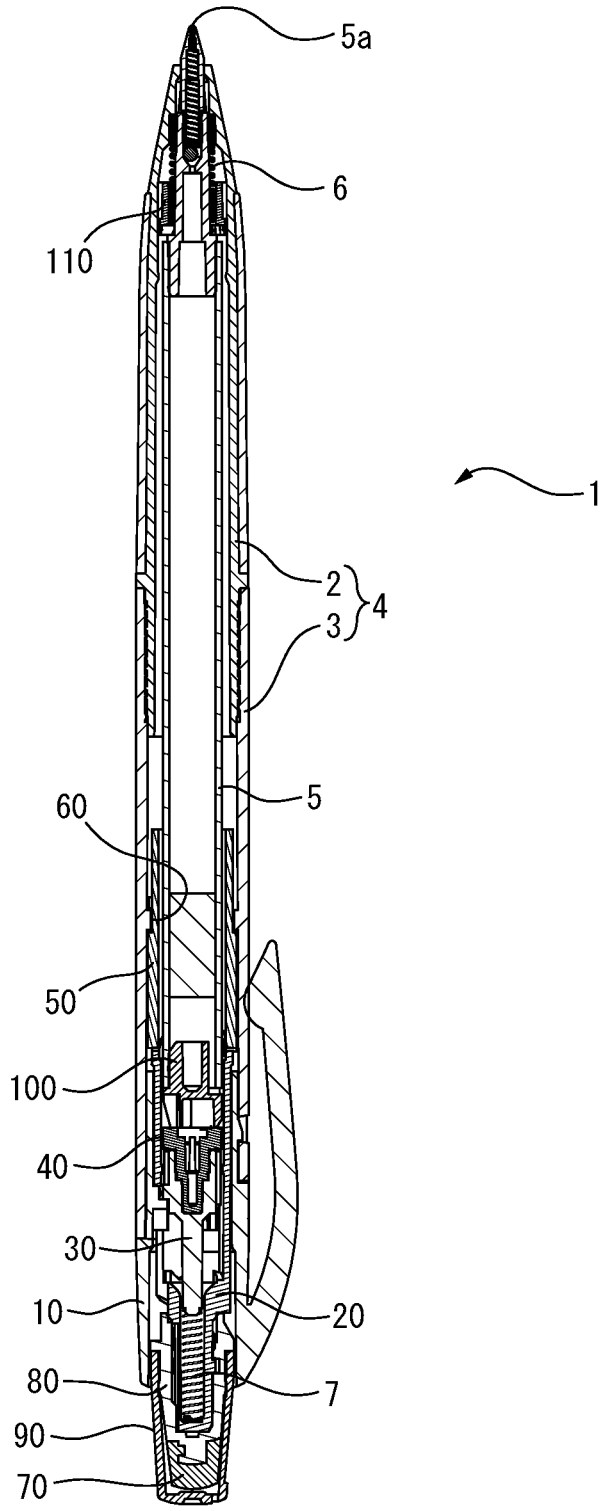
FIG. 1 is a longitudinal cross-sectional view of a knock type writing instrument according to an embodiment of the present invention in the writing state and with the front end turned upward.

Below, while referring to the drawings, embodiments of the present invention will be explained in detail. Throughout the figures, the corresponding component elements are assigned common reference notations.

Figure 2:
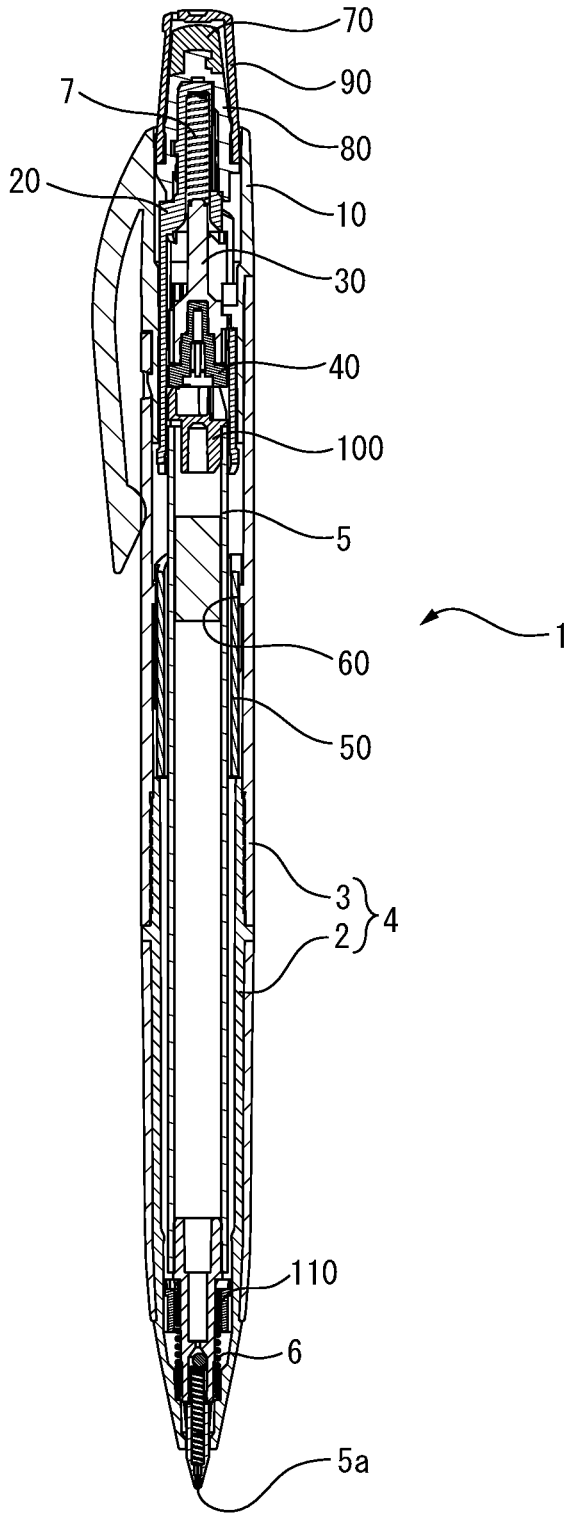
FIG. 2 is a longitudinal cross-sectional view of the knock type writing instrument of FIG. 1 in the writing state and with the front end turned downward.
Figure 3:
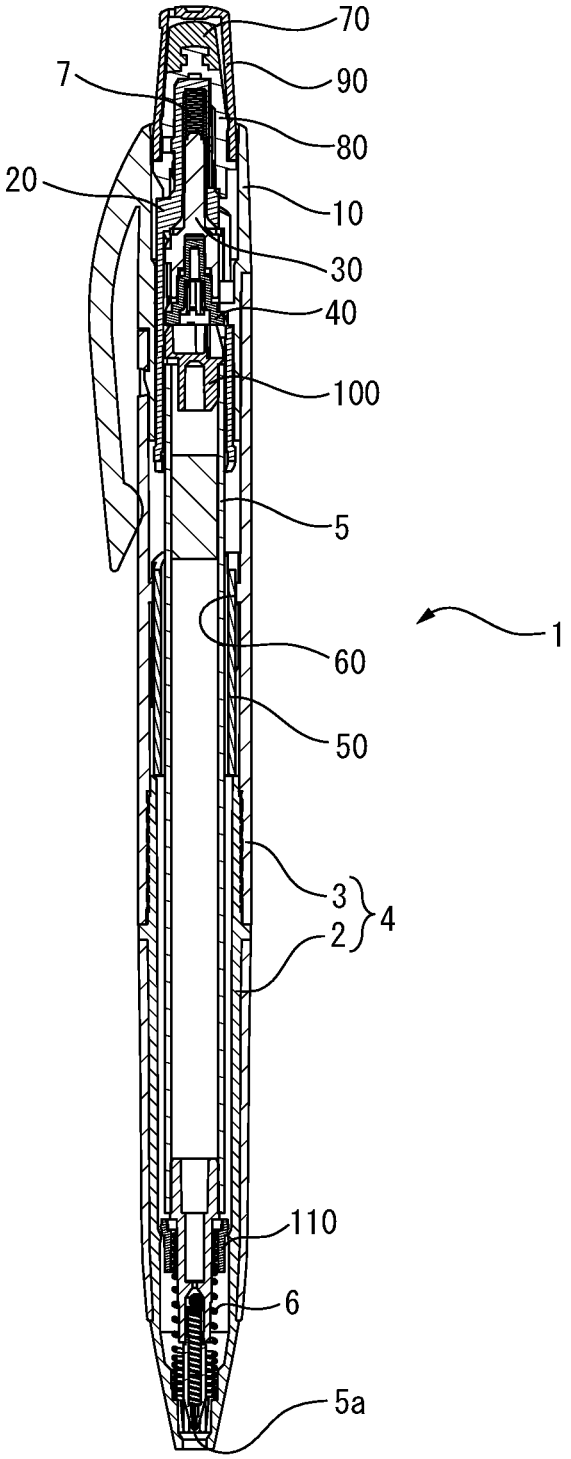
FIG. 3 is a longitudinal cross-sectional view of the knock type writing instrument of FIG. 1 in the nonwriting state and with the front end turned downward.
Figure 4:
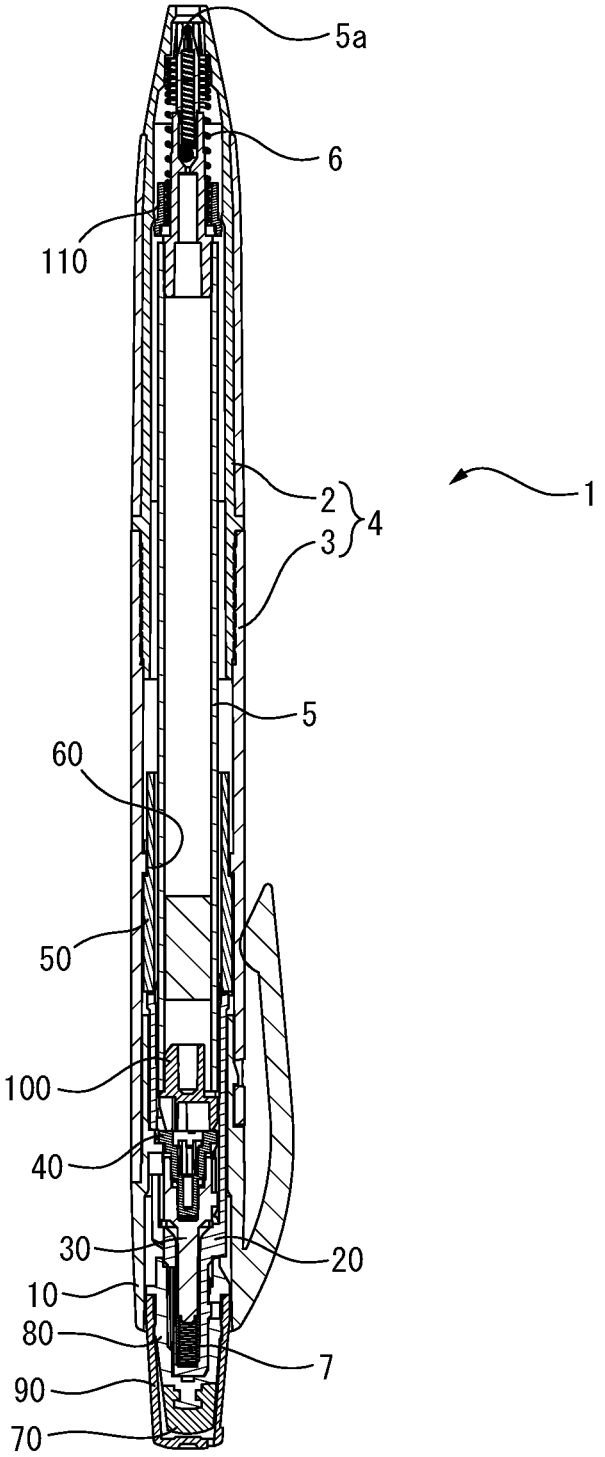
FIG. 4 is a longitudinal cross-sectional view of the knock type writing instrument of FIG. 1 in the nonwriting state and with the front end turned upward.
Figure 5:
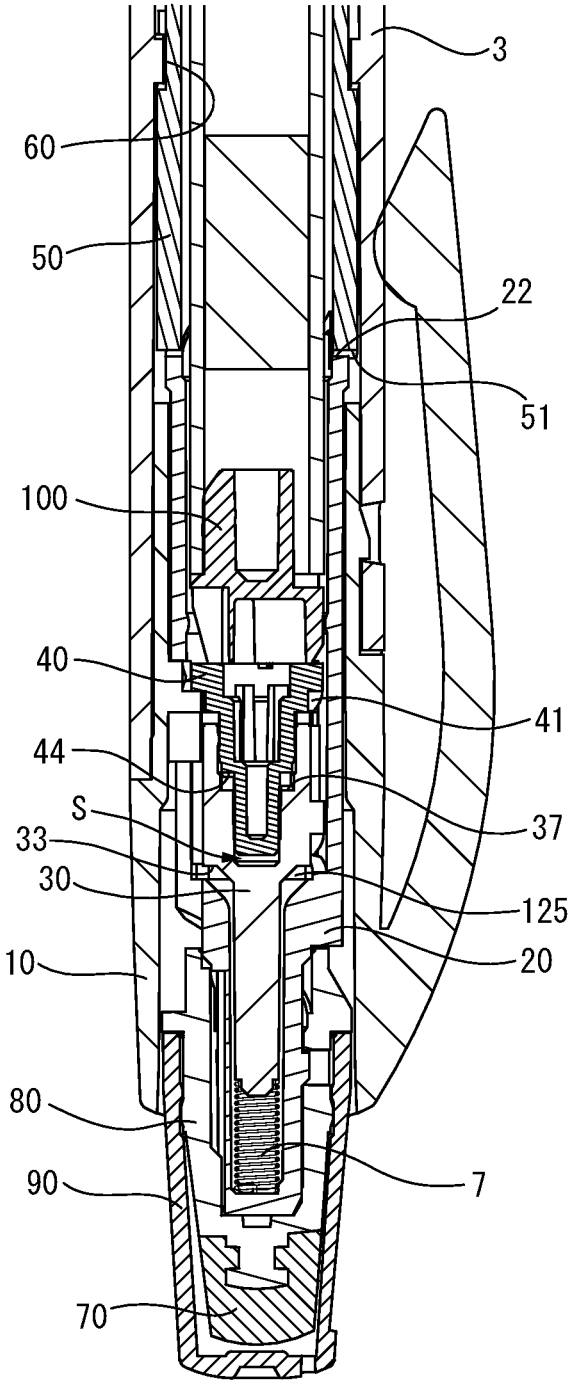
FIG. 5 is an enlarged cross-sectional view of a back end part of the knock type writing instrument of FIG. 3.

FIG. 1 is a longitudinal cross-sectional view of a knock type writing instrument 1 in the writing state and with the front end turned upward, FIG. 2 is a longitudinal cross-sectional view of the knock type writing instrument 1 in the writing state and with the front end turned downward, FIG. 3 is a longitudinal cross-sectional view of the knock type writing instrument 1 in the nonwriting state and with the front end turned downward, and FIG. 4 is a longitudinal cross-sectional view of the knock type writing instrument 1 in the nonwriting state and with the front end turned upward. Further, FIG. 5 is an enlarged cross-sectional view of a back end part of the knock type writing instrument 1 of FIG. 3. In FIG. 1 to FIG. 4, upward is vertical upward, while downward is vertical downward. That is, gravity acts downward in the figures.

The knock type writing instrument 1 has a barrel 2 formed into a tubular shape, a refill 5 as a writing member arranged inside the barrel 2 and provided with a writing part 5*a* at one end, a spring 6 as an elastic member biasing the refill 5 backward, an inner tube 10 attached to a back end part of the barrel 2 and provided with a clip for holding an article, and a hollow operating part 20 arranged inside the inner tube 10. The barrel 2 has a front barrel 3 and a back barrel 4. The inner tube 10, front barrel 3, and back barrel 4 will also be referred to altogether as the "barrel".

In the Description, in the axial direction of the knock type writing instrument 1, the writing part 5*a* side is defined as the "front" side, while the side opposite to the writing part 5*a* is defined as the "back" side. Unless particularly alluded to, the "center axis" refers to the center axis of the knock type writing instrument 1. In the knock type writing instrument 1, due to a knock operation pushing the operating part 20 forward against the biasing force of the spring 6, the refill 5 moves inside the barrel 2 in the front-back direction. At this time, the state in which the writing part 5*a* projects out from the barrel 2 will be referred to as the "writing state" (FIG. 1 and FIG. 2), while the state where the writing part 5*a* is retracted inside the barrel 2 will be referred to as the "nonwriting state" (FIG. 3 and FIG. 4).

The knock type writing instrument 1 further has a main rotor 30 as an engaging member arranged inside the operating part 20, a speed reducing rotor 40 arranged inside the operating part 20 in front of the main rotor 30, a knock lock member 50 arranged in front of the operating part 20 and formed into a tubular shape, a locking part 60 locking with the knock lock member 50, an erasing member 70 attached to a back end part of the operating part 20, a holding member 80 for attaching the erasing member 70 to the operating part 20, a cover member 90 covering the erasing member 70, a refill cap 100 inserted into and attached to the back end part of the refill 5, and a braking member 110 attached near the front end part of the refill 5.

The main rotor 30 cooperates with an external cam 11 of the inner tube 10 and the operating part 20, while the speed reducing rotor 40 cooperates with the external cam 11 of the inner tube 10 and the main rotor 30. Further, a lock cam face 22 of the operating part 20 and a lock cam receiving surface 51 of the knock lock member 50 cooperate to cause the knock lock member 50 to rotate about the center axis and cause the knock lock member 50 and the locking part 60 to lock. Below, details will be explained.

The knock lock member 50 can move by gravity inside the barrel 2 in the front-back direction. Therefore, FIG. 1 and FIG. 2 similarly show the writing state of the knock type writing instrument 1, but in FIG. 1, the front end of the knock type writing instrument 1, that is, the front end of the barrel 2, is turned upward, so the knock lock member 50 moves inside the barrel 2 to the back end side. On the other hand, in FIG. 2, the front end of the knock type writing instrument 1, that is, the front end of the barrel 2, is turned downward, so the knock lock member 50, compared with FIG. 1, moves inside the barrel 2 to the front end side.

Similarly, FIG. 3 and FIG. 4 both show the nonwriting state of the knock type writing instrument 1, but in FIG. 3, the front end of the knock type writing instrument 1, that is, the front end of the barrel 2, is turned downward, so the knock lock member 50 moves inside the barrel 2 to the front end side. On the other hand, in FIG. 4, the front end of the knock type writing instrument 1, that is, the front end of the barrel 2, is turned upward, so the knock lock member 50, compared with FIG. 3, moves inside the barrel 2 to the back end side.

Figure 6:
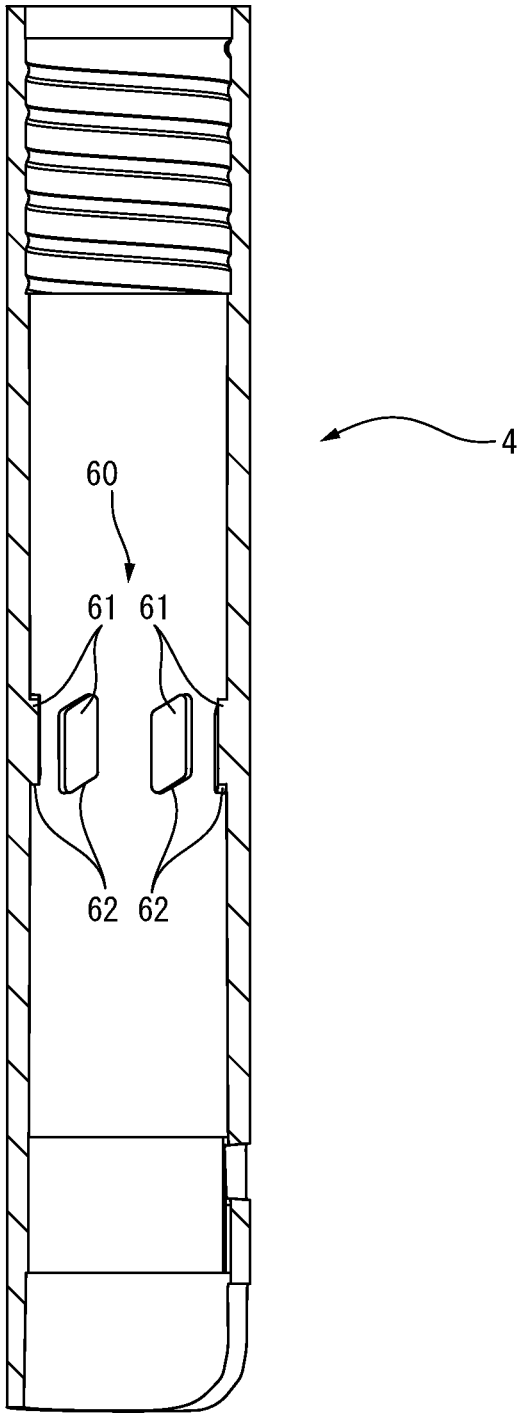
FIG. 6 is a longitudinal cross-sectional view of a back barrel of the knock type writing instrument of FIG. 1.

FIG. 6 is a longitudinal cross-sectional view of the back barrel 4 of the knock type writing instrument 1. In FIG. 6, the upward part is the front side of the knock type writing instrument 1. At the intermediate part at the inner surface of the back barrel 4, the locking part 60 is provided. The locking part 60 has six projecting parts 61 arranged at equal intervals along the circumferential direction as second projecting parts as opposed to the first projecting parts 52 of the knock lock member 50 explained later. The second projecting parts 61 are parallelograms in transverse cross-section. Further, at the back end surfaces of the second projecting parts 61, slanted surfaces 62 are formed slanted in the circumferential direction with respect to a plane vertical to the front-back direction.

Figure 7:
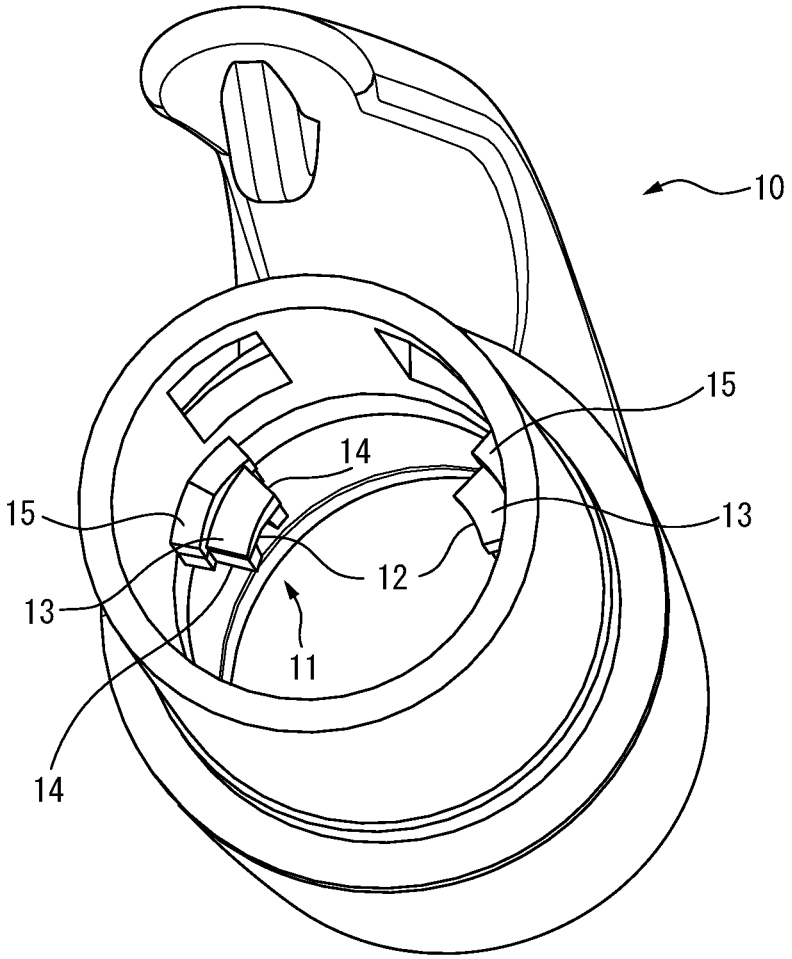
FIG. 7 is a perspective view of an inner tube of the knock type writing instrument of FIG. 1.
Figure 8:
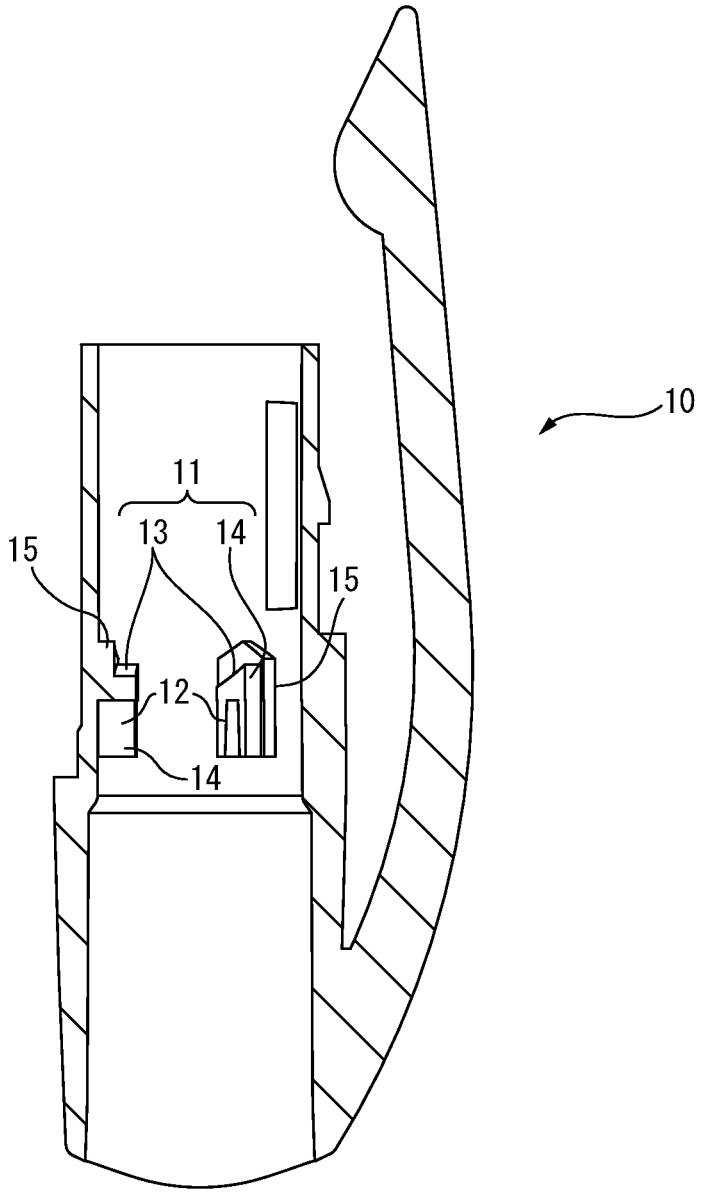
FIG. 8 is a longitudinal cross-sectional view of the inner tube of the knock type writing instrument of FIG. 1.

FIG. 7 is a perspective view of the inner tube 10 of the knock type writing instrument 1, while FIG. 8 is a longitudinal cross-sectional view of the inner tube 10 of the knock type writing instrument 1. In FIG. 8, the upward part is the front side of the knock type writing instrument 1. The inner tube 10 fits into the back end part of the barrel 2. At the inner surface of the inner tube 10, the external cam 11 is provided. The external cam 11 has three projecting parts 12 arranged at equal intervals along the circumferential direction. At the front end surfaces of the projecting parts 12, slanted surfaces 13 are formed slanted in the circumferential direction with respect to a plane vertical to the front-back direction. The slanted surfaces 13 form the first cam face. The individual projecting parts 12 have limiting surfaces extending along the front-back direction, that is, vertical wall surfaces 14. Note that, the individual projecting parts 12 are provided at the inner surface of the inner tube 10 through guide projections 15 with larger areas of transverse cross-sections.

Figure 9:
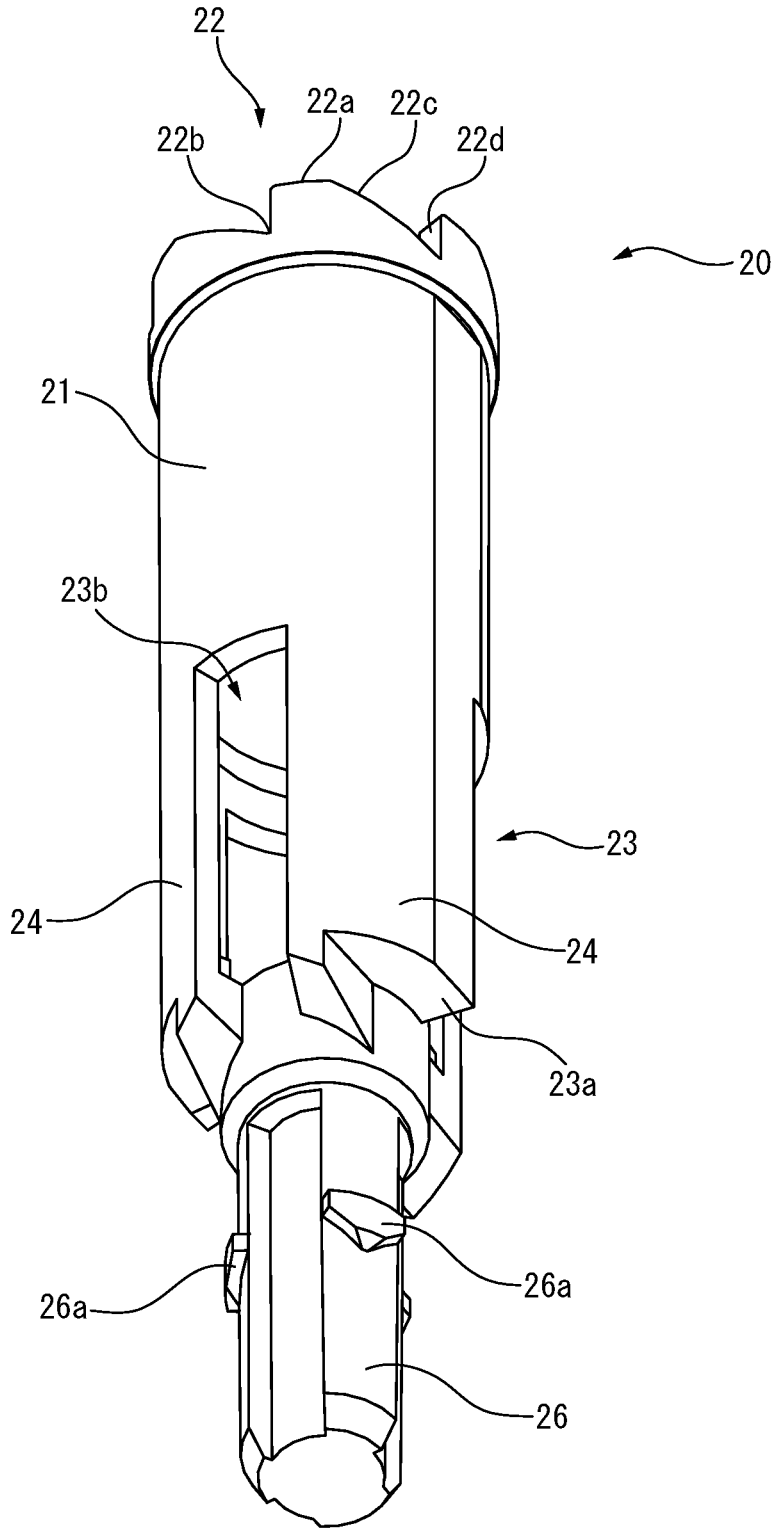
FIG. 9 is a perspective view of an operating part of the knock type writing instrument of FIG. 1.
Figure 10:
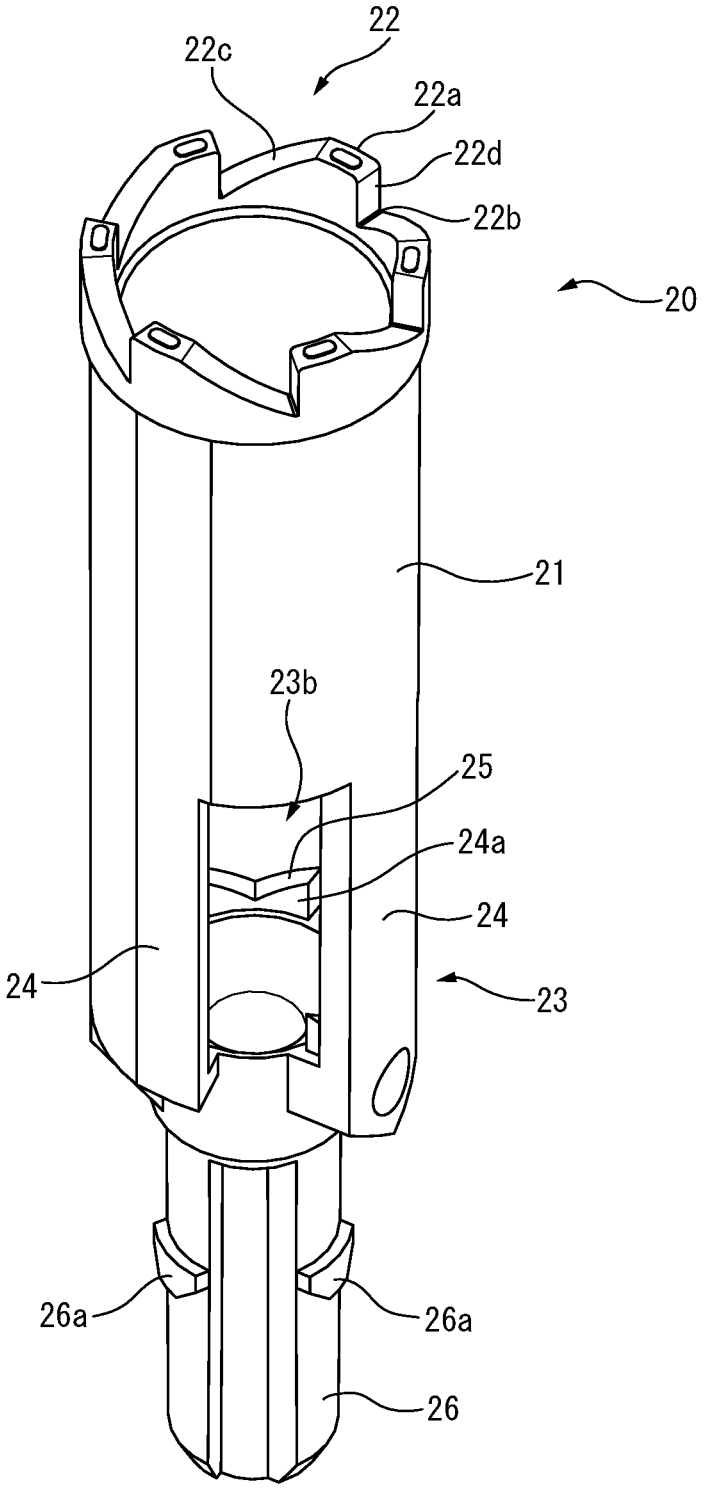
FIG. 10 is another perspective view of the operating part of the knock type writing instrument of FIG. 1.
Figure 11:
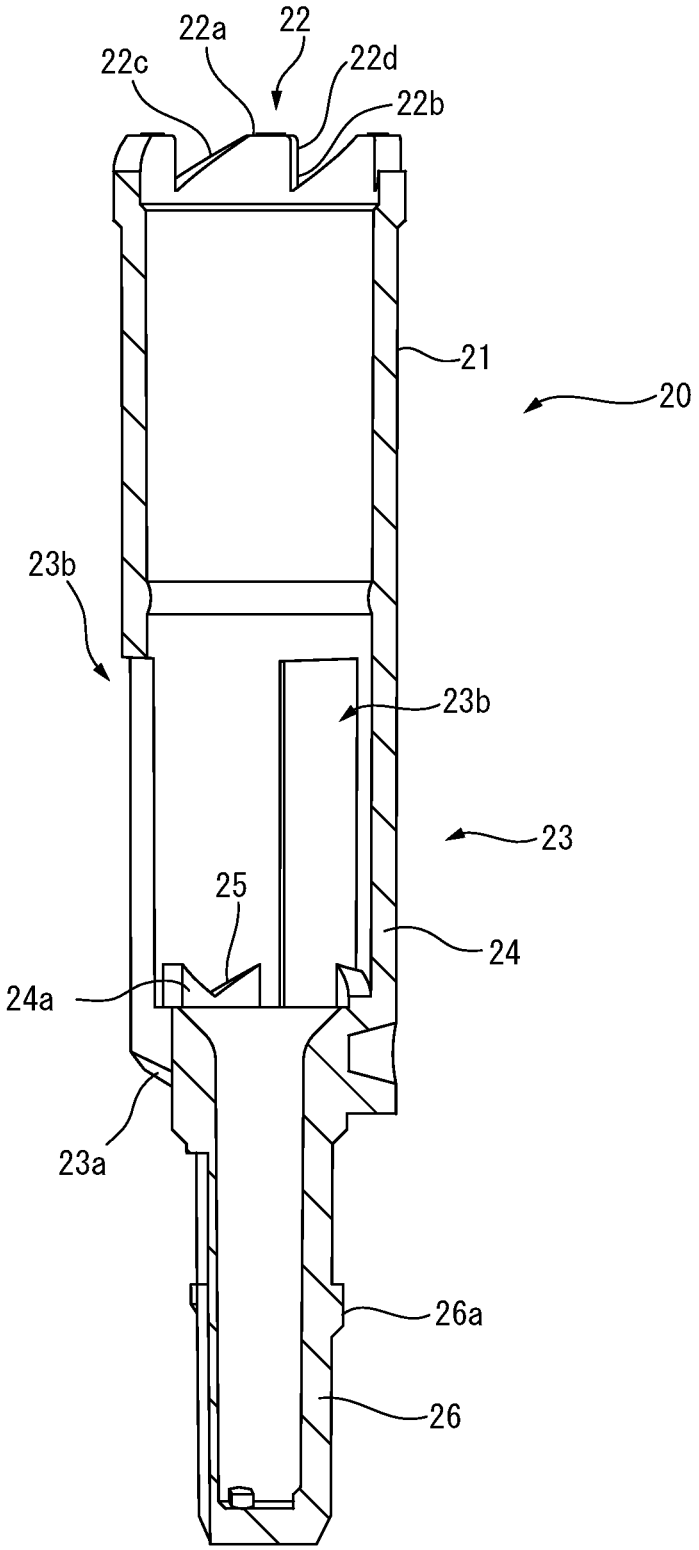
FIG. 11 is a longitudinal cross-sectional view of the operating part of the knock type writing instrument of FIG. 1.

FIG. 9 is a perspective view of the operating part 20 of the knock type writing instrument 1, FIG. 10 is another perspective view of the operating part 20 of the knock type writing instrument 1, and FIG. 11 is a longitudinal cross-sectional view of the operating part 20 of the knock type writing instrument 1. In FIG. 9 to FIG. 11, the upper part is the front side of the knock type writing instrument 1.

The operating part 20 is a tubular member. The operating part 20 has a cylindrical part 21 having a smooth outer circumferential surface at the center part in the axial direction. The forward part of the cylindrical part 21 is formed to just a slightly larger outside diameter, and at that front end surface, a saw tooth shaped lock cam face 22 is formed. The lock cam face 22 has six peak parts 22*a* and valley parts 22*b*. In more detail, the peak parts 22*a* and valley parts 22*b* are configured so that the lock cam face 22 has slanted parts 22*c* slanted in the circumferential direction with respect to a plane vertical to the front-back direction and vertical wall parts 22*d* extending along the front-back direction. The peak parts 22*a* of the lock cam face 22 of the operating part 20 are asymmetric along the circumferential direction, but may also be symmetric shapes.

At the back of the cylindrical part 21, a guide part 23 is formed. At the back end of the guide part 23, a back wall 23*a* is provided. At the guide part 23, three slits 23*b* are formed along the axial direction. The three slits 23*b* are made to penetrate to the inside and are arranged at equal intervals along the circumferential direction. Therefore, due to the three slits 23*b*, three columnar parts 24 with substantially fan-shaped cross-sections are defined.

At the inner surfaces of the columnar parts 24, projecting parts 24*a* extending from the inner wall of the back wall 23*a* forward are formed. At the front end surfaces of the projecting parts 24*a*, V-shaped cam faces 25 are formed with V-shapes opening forward in obtuse angles. That is, at the inner surface of the guide part 23, three V-shaped cam faces 25 are formed. At the back end surface of the guide part 23, that is, the back end surface of the back wall 23*a* of the guide part 23, a hollow mating part 26 is formed extending backward. At the outer circumferential surface of the mating part 26, mating projections 26*a* are formed extending outward in the radial direction.

The operating part 20 is inserted inside the inner tube 10 from the front. At that time, the guide projections 15 of the inner tube 10 are arranged inside the slits 23*b* of the operating part 20, therefore, the columnar parts 24 of the operating part 20 are arranged between the guide projections 15 of the inner tube 10. By the guide projections 15 of the inner tube 10 being arranged inside the slits 23*b* of the operating part 20, the operating part 20 is restricted in rotation about the center axis and can move along the slits 23*b* in the front-back direction. Further, the respective projecting parts 12 provided on the guide projections 15 project out through the slits 23*b* to the inside of the guide part 23 of the operating part 20, and the amounts of projection are substantially the same as the amounts of projection of the projecting parts 24*a* from the inner surfaces of the columnar parts 24. Therefore, the projecting parts 12 of the inner tube 10 and the projecting parts 24*a* of the operating part 20 cooperate to act on an internal cam 32 of the main rotor 30 as explained later.

Figure 12:
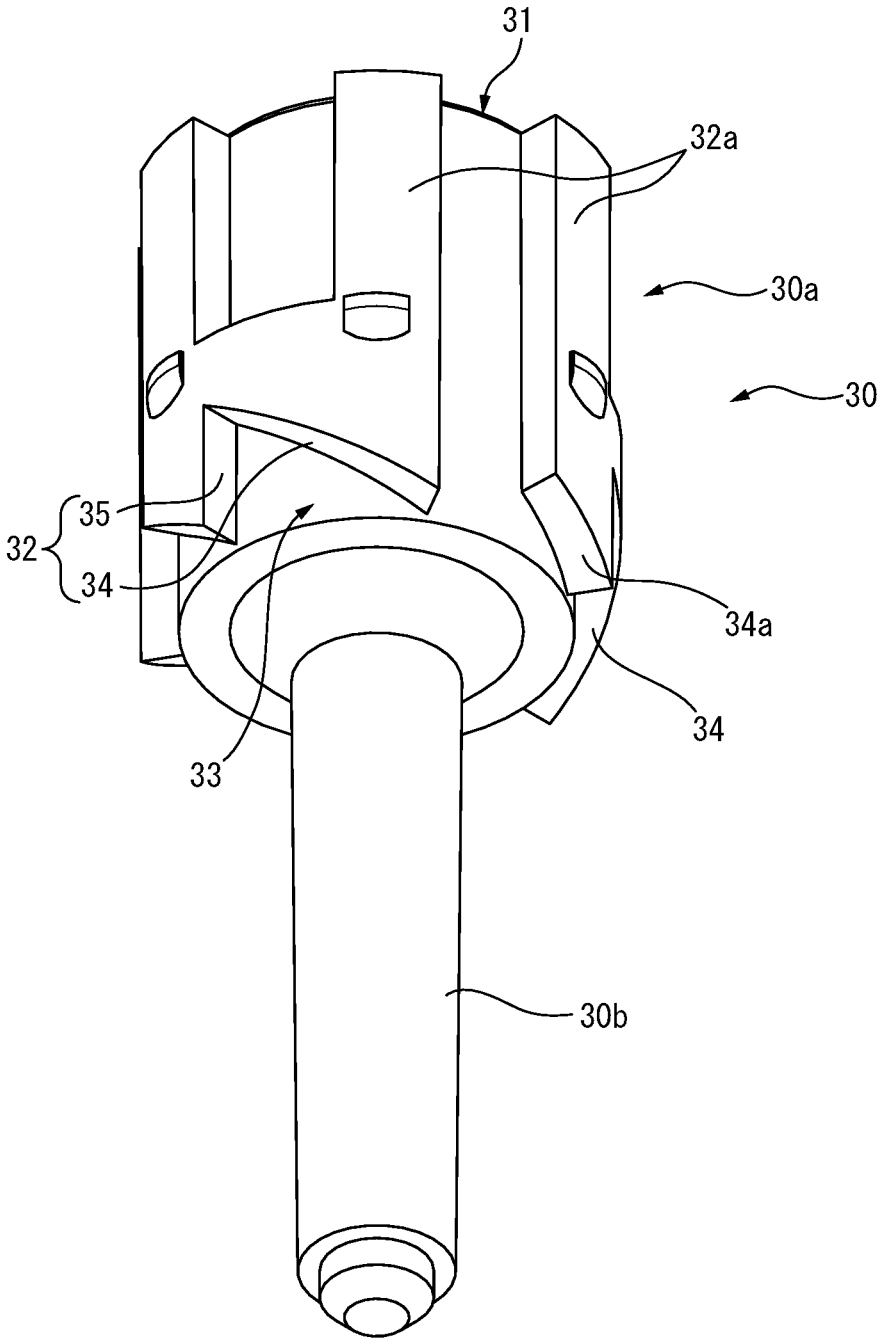
FIG. 12 is a perspective view of a main rotor of the knock type writing instrument of FIG. 1.
Figure 13:
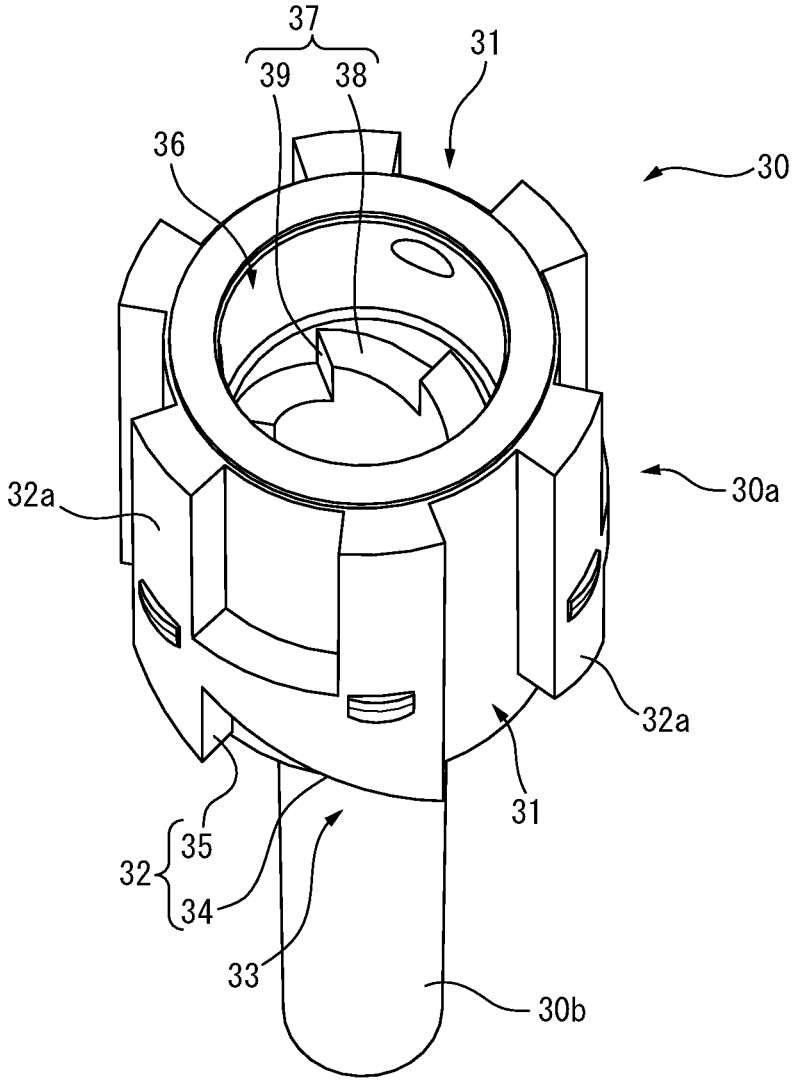
FIG. 13 is another perspective view of the main rotor of the knock type writing instrument of FIG. 1.
Figure 14:
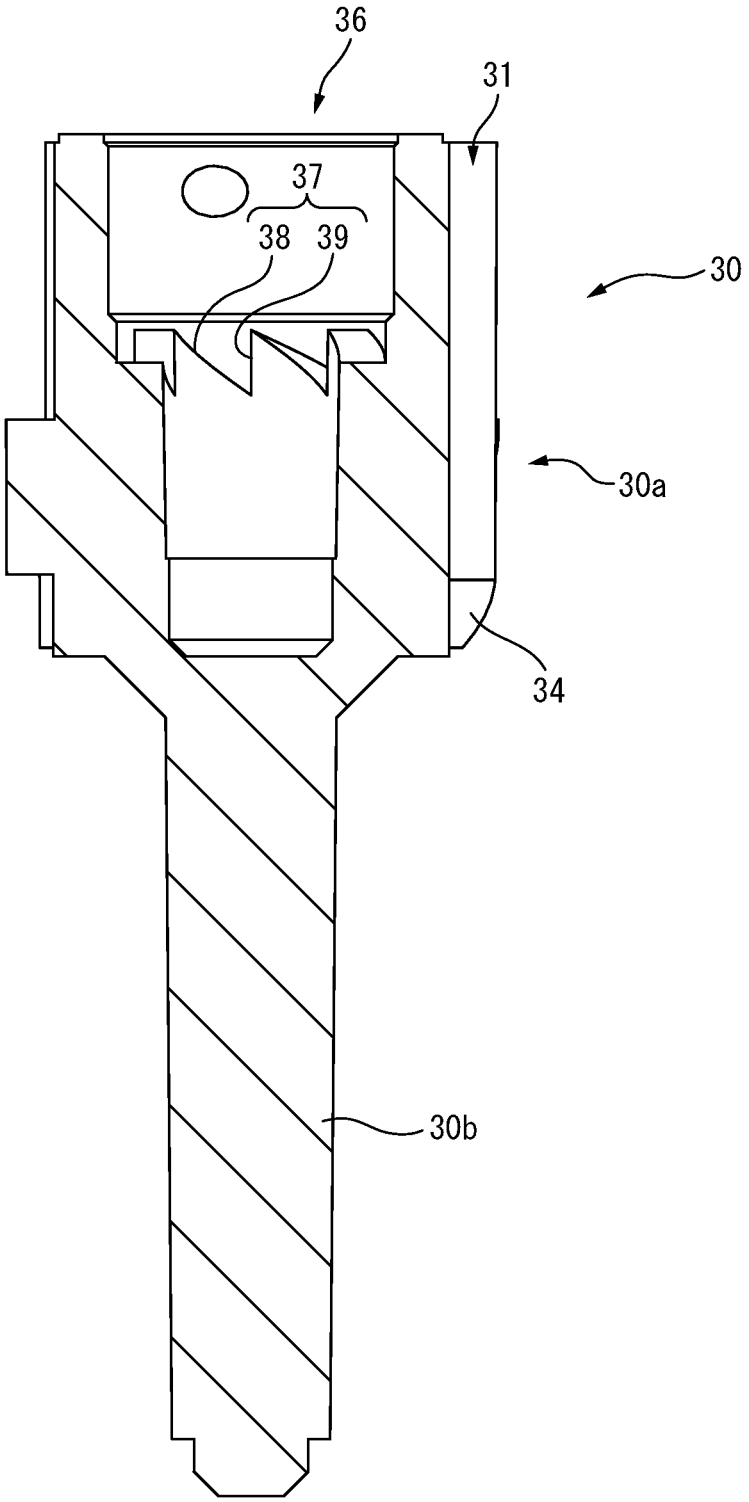
FIG. 14 is a longitudinal cross-sectional view of the main rotor of the knock type writing instrument of FIG. 1.

FIG. 12 is a perspective view of the main rotor 30 of the knock type writing instrument 1, FIG. 13 is another perspective view of the main rotor 30 of the knock type writing instrument 1, and FIG. 14 is a longitudinal cross-sectional view of the main rotor 30 of the knock type writing instrument 1. In FIG. 12 to FIG. 14, the upper parts are the front side of the knock type writing instrument 1.

The main rotor 30 is comprised of a large diameter part 30*a* and a small diameter part 30*b* formed at the back of the large diameter part 30*a* and inserted in the operating part 20 for centering. The large diameter part 30*a* has a diameter larger than the small diameter part 30*b*. The outside diameter of the large diameter part 30*a* is set just slightly smaller than the inside diameter of the cylindrical part 21 of the operating part 20 to which it is inserted.

At the outer circumferential surface of the large diameter part 30*a*, three vertical grooves 31 are formed arranged at equal intervals along the circumferential direction and extending along the front-back direction. The depths of the vertical grooves 31 are shallower than a difference in radius between the large diameter part 30*a* and the small diameter part 30*b*. At the large diameter part 30*a*, an internal cam 32 is formed comprised of three projecting parts 32*a* defined by the three vertical grooves 31. At the back end surface of the large diameter part 30*a*, a cam receiving surface 33 is formed over the entire circumference cooperating with the V-shaped cam faces 25 of the operating part 20. That is, the internal cam 32 has the cam receiving surface 33.

The cam receiving surface 33 is formed in a saw tooth shape and has 12 slanted surfaces 34 slanted in the circumferential direction with respect to a plane vertical to the front-back direction. At the three slanted surfaces 34, every other slanted surface 34*a* is cut into by the above-mentioned vertical groove 31. Adjoining slanted surfaces 34 between adjoining vertical grooves 31 are connected by vertical wall surfaces 35 extending along the front-back direction. That is, the cam receiving surface 33 has three vertical wall surfaces 35. The cam receiving surface 33 of the main rotor 30 is formed into an asymmetric saw tooth shape, but may also be formed symmetric.

At the flat front end surface of the large diameter part 30*a*, a hole 36 is formed having a cylindrical inner surface concentric with the center axis of the main rotor 30. At the hole 36, the speed reducing rotor 40 is inserted. The cylindrical inner surface of the hole 36 has two different diameters, and these diameters are just slightly larger than the later explained medium diameter part 40*b* and small diameter part 40*c* of the speed reducing rotor 40. At the hole 36, a second cam face constituted by the speed reducing cam face 37 is formed at the back end surface of the small diameter part arranged at the back end side.

The speed reducing cam face 37 is formed into a saw tooth shape and has six slanted surfaces 38 slanted in the circumferential direction with respect to a plane vertical to the front-back direction. The adjoining slanted surfaces 38 of the speed reducing cam face 37 are connected by the vertical wall surfaces 39 extending along the front-back direction. The slanted surfaces 38 of the speed reducing cam faces 37 and the slanted surfaces 34 of the cam receiving surface 33 are slanted in opposite directions to each other.

The main rotor 30 is inserted into the operating part 20 from the front. The internal cam 32 of the main rotor 30 engages with or disengages from the external cam 11 if a knock operation causes the main rotor 30 to rotate about the center axis. That is, the projecting parts 32*a* of the internal cam 32 engage with the projecting parts 12 of the external cam 11 projecting out into the operating part 20 through the slits 23*b* or are arranged between the projecting parts 12 of the external cam 11 if a knock operation causes the main rotor 30 to rotate about the center axis. When the internal cam 32 is arranged in the external cam 11, the projecting parts 12 of the external cam 11 are arranged between the projecting parts 32*a* of the internal cam 32, that is, inside the vertical grooves 31.

The V-shaped cam faces 25 of the operating part 20 and the cam receiving surface 33 of the main rotor 30 are configured so that the V-shaped cam faces 25 and the cam receiving surface 33 are offset in phase when the internal cam 32 is engaged with or disengaged from the external cam 11. For this reason, if a knock operation causes the slanted surfaces of the V-shaped cam faces 25 to push against the slanted surfaces 34 of the cam receiving surface 33, due to this operating load and the biasing force of the spring 6, the main rotor 30 receives a force component of the circumferential direction and rotates about the center axis. On the one hand, the operating part 20, as explained above, is restricted in rotation about the center axis due to the guide projections 15 of the inner tube 10 being arranged inside the slits 23*b*.

Figure 15:
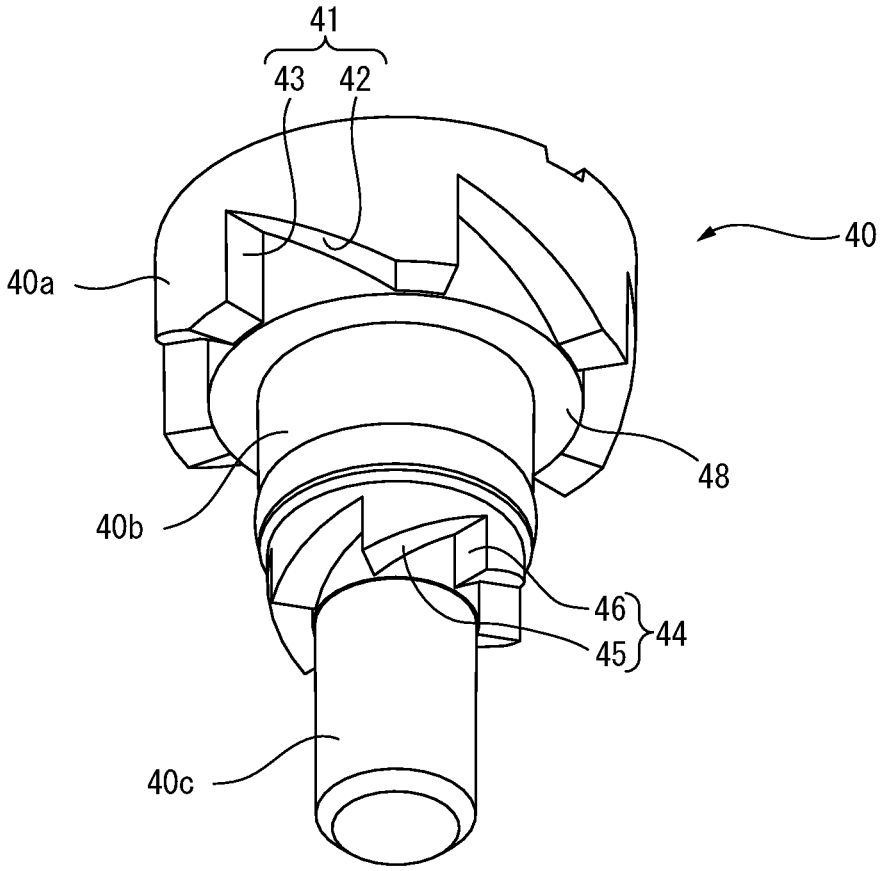
FIG. 15 is a perspective view of a speed reducing rotor of the knock type writing instrument of FIG. 1.
Figure 16:
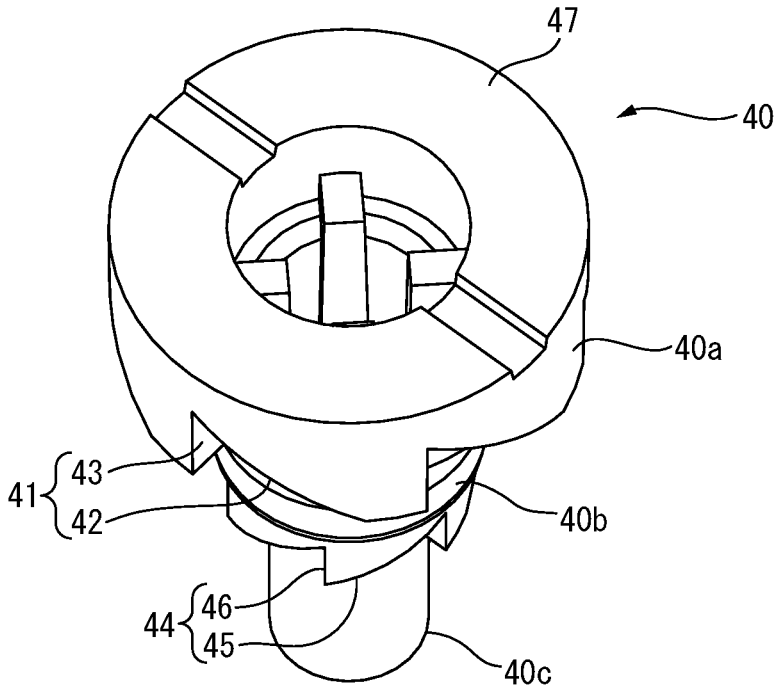
FIG. 16 is another perspective view of the speed reducing rotor of the knock type writing instrument of FIG. 1.
Figure 17:
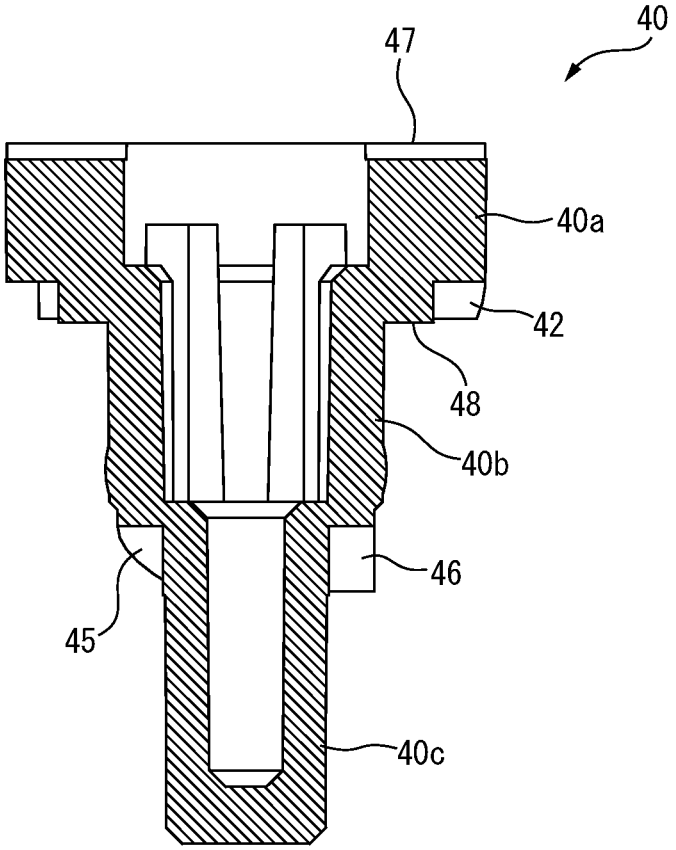
FIG. 17 is a longitudinal cross-sectional view of the speed reducing rotor of the knock type writing instrument of FIG. 1.

FIG. 15 is a perspective view of the speed reducing rotor 40 of the knock type writing instrument 1, FIG. 16 is another perspective view of the speed reducing rotor 40 of the knock type writing instrument 1, and FIG. 17 is a longitudinal cross-sectional view of the speed reducing rotor 40 of the knock type writing instrument 1. In FIG. 15 to FIG. 17, the upper part is the front side of the knock type writing instrument 1. The speed reducing rotor 40 is formed by the same material as the main rotor 30, but may also be formed by a different material.

The speed reducing rotor 40 is comprised of a large diameter part 40*a*, a medium diameter part 40*b* formed at the back of the large diameter part 40*a*, and a small diameter part 40*c* formed at the back of the medium diameter part 40*b*. The large diameter part 40*a* has a diameter larger than the medium diameter part 40*b*, while the medium diameter part 40*b* has a diameter larger than the small diameter part 40*c*. The medium diameter part 40*b* and small diameter part 40*c* are inserted into the hole 36 of the main rotor 30.

At the outer circumferential surface of the large diameter part 40*a*, a ring-shaped projection is formed, and at the front end surface of the ring-shaped projection, a first cam receiving surface constituted by a first speed reducing cam receiving surface 41 is formed. The first speed reducing cam receiving surface 41 is formed in a saw tooth shape and has six slanted surfaces 42 slanted in the circumferential direction with respect to a plane vertical to the front-back direction. The adjoining slanted surfaces 42 of the first speed reducing cam receiving surface 41 are connected by vertical wall surfaces 43 extending along the front-back direction.

At the back end surface of the medium diameter part 40*b*, a second cam receiving surface constituted by a second speed reducing cam receiving surface 44 is formed arranged facing the speed reducing cam face 37 of the main rotor 30 and of a complementary shape so as to intermesh with the speed reducing cam face 37. Therefore, the second speed reducing cam receiving surface 44, like the speed reducing cam face 37 of the main rotor 30, is formed in a saw tooth shape and has six slanted surfaces 45 slanted in the circumferential direction with respect to a plane vertical to the front-back direction. The adjoining slanted surfaces 45 of the second speed reducing cam receiving surface 44 are connected by vertical wall surfaces 46 extending along the front-back direction. The slanted surfaces 42 of the first speed reducing cam receiving surface 41 and the slanted surfaces 45 of the second speed reducing cam receiving surface 44 are slanted in opposite directions to each other. The slanted surfaces 42 of the first speed reducing cam receiving surface 41 are slanted in the same direction as the slanted surfaces 13 of the external cam 11.

At the back end surface of the large diameter part 40*a*, that is, the front end surface of the speed reducing rotor 40, a flat refill supporting surface 47 is formed. The refill supporting surface 47 always contacts the back end surface of the refill 5 biased by the spring 6 backward. Therefore, the speed reducing rotor 40 moves in the front-back direction together with the refill 5. At the front end surface of the large diameter part 40*a*, a flat rotor abutting surface 48 is formed. The rotor abutting surface 48 abuts against the back end surface of the main rotor 30 when the speed reducing cam face 37 of the main rotor 30 and the second speed reducing cam receiving surface 44 of the speed reducing rotor 40 intermesh.

The biasing force of the spring 6 is mainly transmitted to the operating part 20 and main rotor 30 through the refill supporting surface 47 and rotor abutting surface 48 of the speed reducing rotor 40. In other words, except when the external cam 11 and the internal cam 32 are engaged, the operating part 20, main rotor 30, and speed reducing rotor 40 move as one piece.

Figure 18:
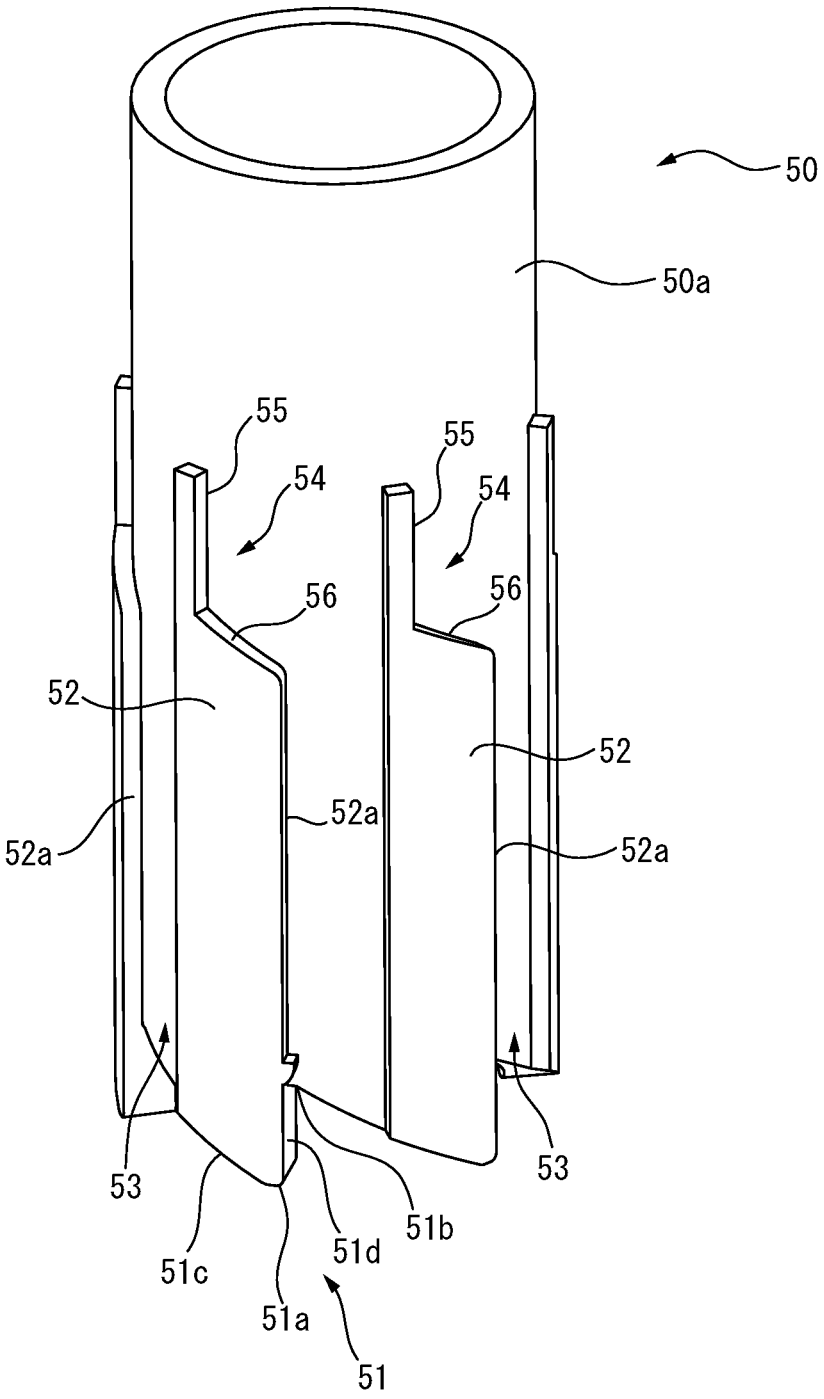
FIG. 18 is a perspective view of a knock lock member of the knock type writing instrument of FIG. 1.
Figure 19:
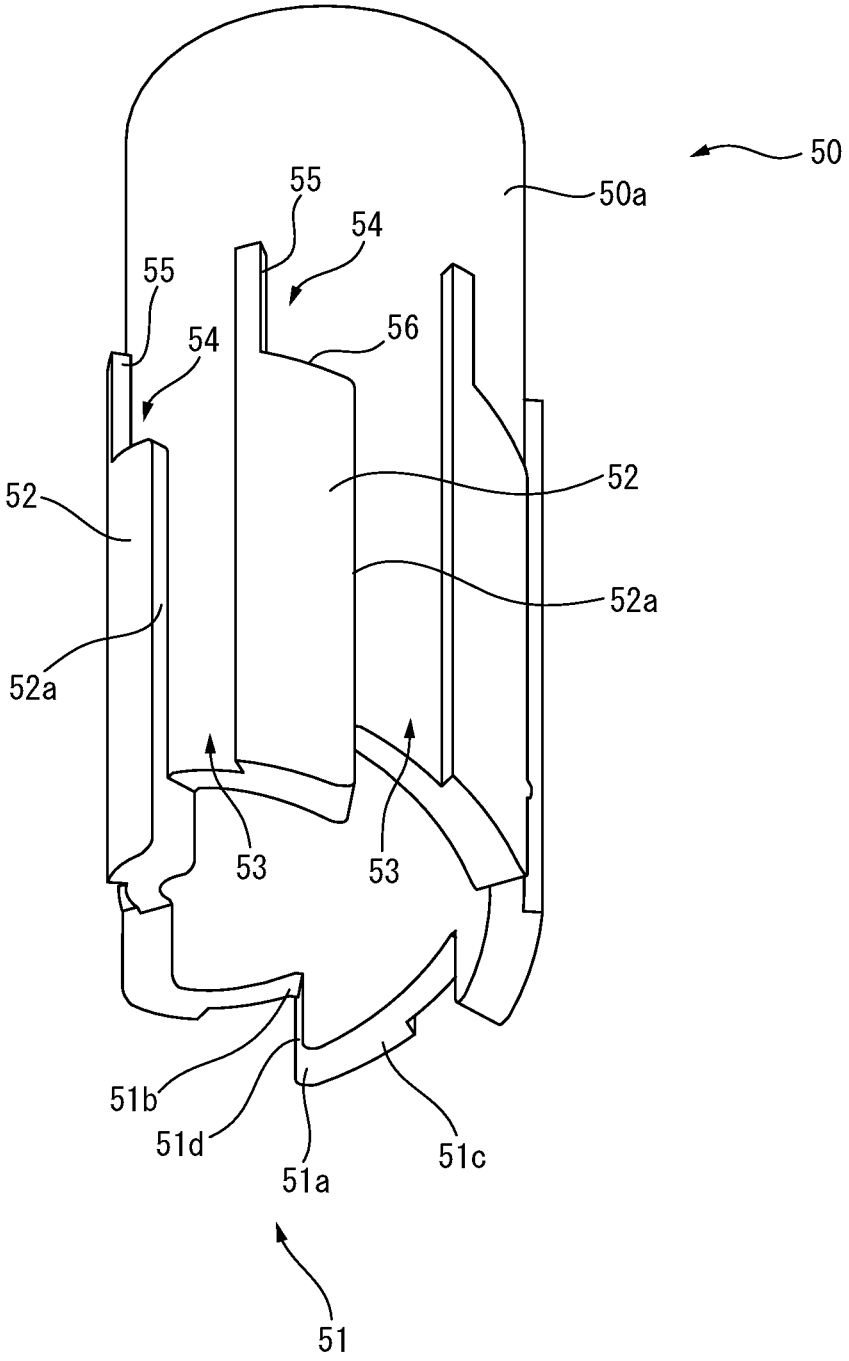
FIG. 19 is another perspective view of the knock lock member of the knock type writing instrument of FIG. 1.

FIG. 18 is a perspective view of the knock lock member 50 of the knock type writing instrument 1, while FIG. 19 is another perspective view of the knock lock member 50 of the knock type writing instrument 1. In FIG. 18 and FIG. 19, the upper part is the front side of the knock type writing instrument 1. The knock lock member 50 is formed by the same material as the main rotor 30, but may also be formed by a different material.

The knock lock member 50 is a tubular member. The knock lock member 50 is run through by the refill 5 and can move between the operating part 20 and the locking part 60 of the barrel 2 in the front-back direction. At the back end surface of the knock lock member 50, a lock cam receiving surface 51 of a shape complementary with the lock cam face 22 of the operating part 20 is formed. The lock cam receiving surface 51 has six peak parts 51*a* and valley parts 51*b* in the same way as the lock cam face 22 of the operating part 20. That is, at the lock cam receiving surface 51 of the knock lock member 50, the peak parts 51*a* and valley parts 51*b* are configured so as to have slanted parts 51*c* slanted in the circumferential direction with respect to a plane vertical to the front-back direction and vertical wall parts 51*d* extending along the front-back direction.

At the outer circumferential surface of the tubular part 50*a* of the knock lock member 50, there are six first projecting parts 52. The first projecting parts 52 extend in the front-back direction and are arranged at equal intervals along the circumferential direction. Due to the adjoining first projecting parts 52, six guide grooves 53 are defined extending in the front-back direction.

At the side surfaces 52*a* of the first projecting parts 52 in the circumferential direction, in particular, the side surfaces 52*a* of the front end parts, circumferential direction recessed parts 54 are respectively formed. The bottom surfaces of the recessed parts 54 are side surfaces 55 parallel with the side surfaces 52*a* of the first projecting parts 52 in the circumferential direction. The inner surfaces at the back sides of the recessed parts 54 are slanted surfaces 56 slanted in the circumferential direction with respect to a plane vertical to the front-back direction. The recessed parts 54 are formed in step shapes when viewing the first projecting parts 52 from the front to the back. The side surfaces 55 of the first projecting parts 52 act to restrict rotation of the knock lock member 50 about the center axis.

The individual guide grooves 53 of the knock lock member 50 hold inside them the corresponding second projecting parts 61 of the locking part 60 of the barrel 2 so as to be able to move inside the guide grooves 53 relatively to the front and back.

The lock cam face 22 of the operating part 20 and the lock cam receiving surface 51 of the knock lock member 50 are configured so that when the second projecting parts 61 of the locking part 60 are held in the guide grooves 53 of the knock lock member 50, the peak parts 22*a* of the lock cam face 22 are positioned in the circumferential direction on the slanted parts 51*c* of the lock cam receiving surfaces 51. For this reason, for example, as shown in FIG. 1, if the front end of the knock type writing instrument 1 is turned upward, the knock lock member 50 abuts against the operating part 20 due to the action of gravity, but due to the weight of the knock lock member 50 itself, the knock lock member 50 receives a force component of the circumferential direction and rotates about the center axis. On the one hand, the operating part 20 is restricted in rotation about the center axis due to the guide projections 15 of the inner tube 10 being arranged inside the slits 23*b*.

Figure 20:
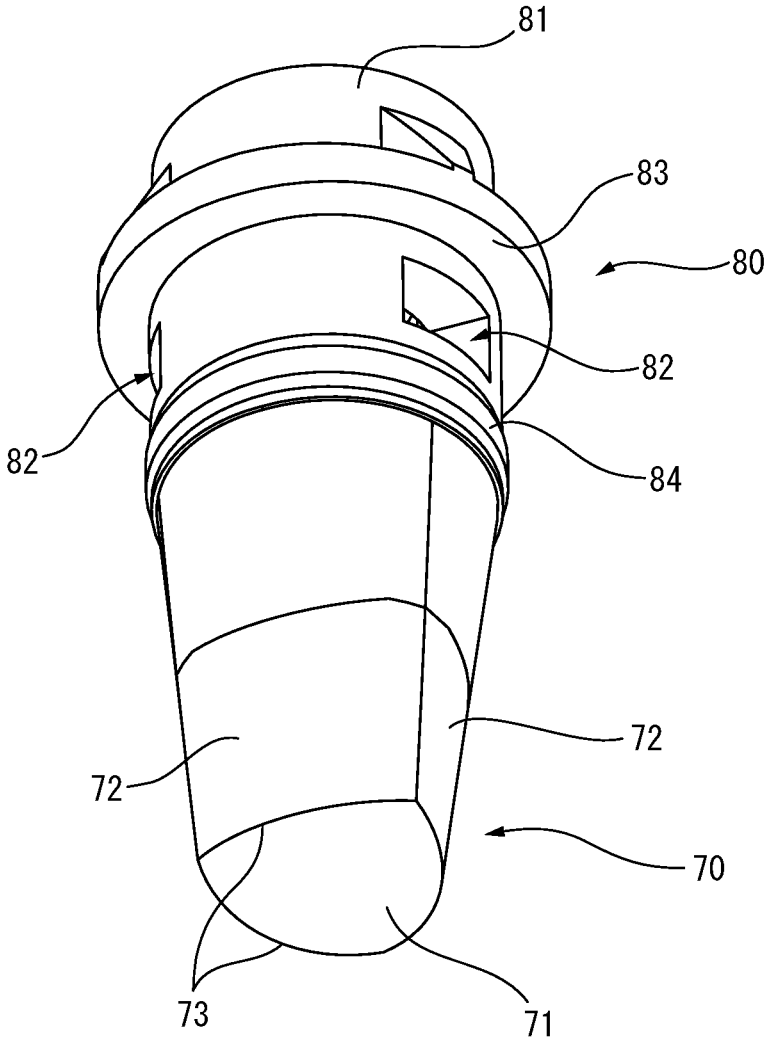
FIG. 20 is a perspective view of an erasing member and holding member of the knock type writing instrument of FIG. 1.
Figure 21:
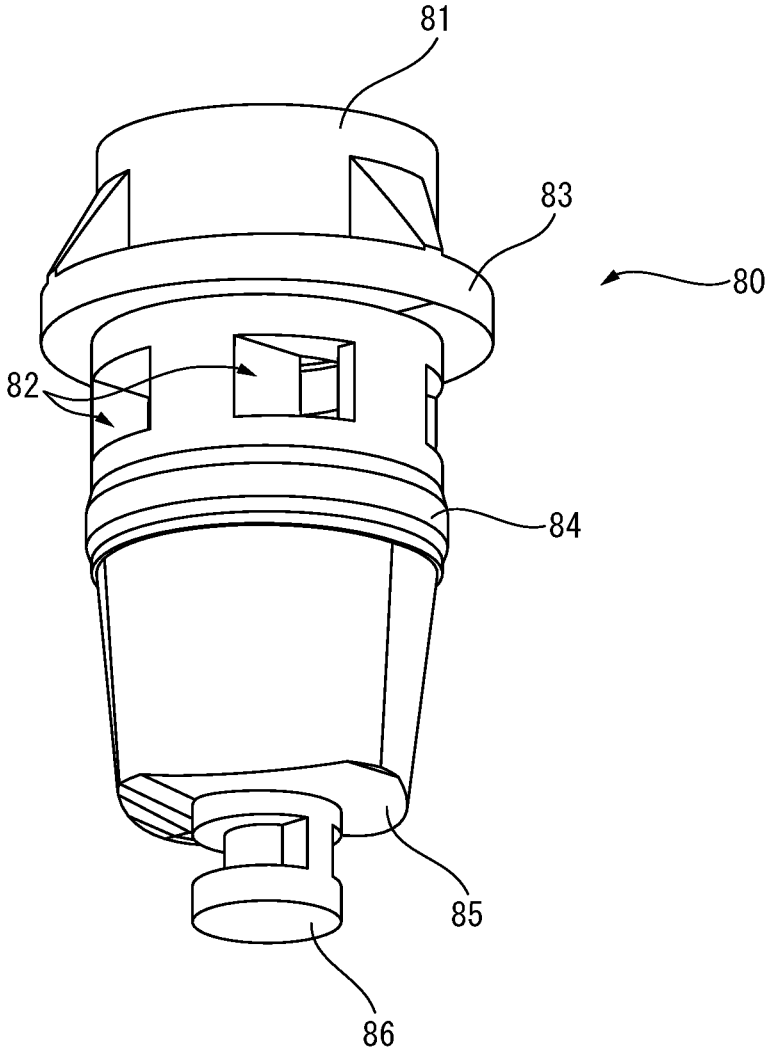
FIG. 21 is a perspective view of a holding member of the knock type writing instrument of FIG. 1.

FIG. 20 is a perspective view of the erasing member 70 and holding member 80 of the knock type writing instrument 1, while FIG. 21 is a perspective view of the holding member 80 of the knock type writing instrument 1. In FIG. 20 and FIG. 21, the upper parts show the front side of the knock type writing instrument 1. If referring to FIG. 5 together with FIG. 20 and FIG. 21, the erasing member 70 is provided at the back end part of the holding member 80 and is attached through the holding member 80 to the back end part of the operating part 20. In other words, part of the operating part 20 functions as the erasing part. The erasing member 70 is provided to fit into the holding member 80 or formed into two colors etc.

The erasing member 70 is formed in a substantially triangular transverse cross-sectional shape of a tapering frustoconical shape. Specifically, in the transverse cross-section, the vertex of the triangular shape is formed in a rounded arc shape, and the radius of curvature of that arc is larger at the back end side of the erasing member 70. The back end surface 71 of the erasing member 70 is formed into a curved shape. Therefore, the boundary between the back end surface 71 of the erasing member 70 and the circumferential surface 72 forms a ridgeline 73.

The erasing member 70 can be rubbed over a broader area by using the back end surface 71. Further, the erasing member 70 can be rubbed over a broader area by using the part of the ridgeline 73 corresponding to one side of the triangular shape and can be rubbed over a narrower area by using the part of the ridgeline 73 corresponding to the vertex of the triangular shape. Note that, only naturally, the transverse cross-sectional shape is not limited to a triangular shape and may also be a quadrilateral shape, hexagonal shape, or other polygonal shape.

The holding member 80 has a holding part body 81. The front part of the holding part body 81 is formed in a tubular shape opening at the front. At the external circumferential surface of the tubular part, a plurality of rectangular openings 82 are formed. Further, at the outer circumferential surface forward from of the openings 82, a flange part 83 is formed. Furthermore, at the outer circumferential surface backward from the openings 82, a ring-shaped projection 84 formed into an annular shape and fitting with the cover member 90 is formed. The back part of the holding part body 81 is formed into a tapered frustoconical shape in the same way as the erasing member 70.

The back end surface of the holding part body 81, that is, the top surface 85, is formed into a curved shape curved in a wave-like manner so that the erasing member 70 provided at the holding member 80 will not end up rotating about the center axis. Similarly, to prevent rotation of the erasing member 70 about the center axis, the top surface 85 is provided with a locking projection 86 projecting rearward and locking with the erasing member 70. The holding member 80 is attached by fitting with the mating part 26 of the operating part 20. That is, if the mating part 26 of the operating part 20 is inserted into the holding member 80, the mating projections 26*a* of the operating part 20 fit with the inside of the opening 82 of the holding part body 81.

Figure 22:
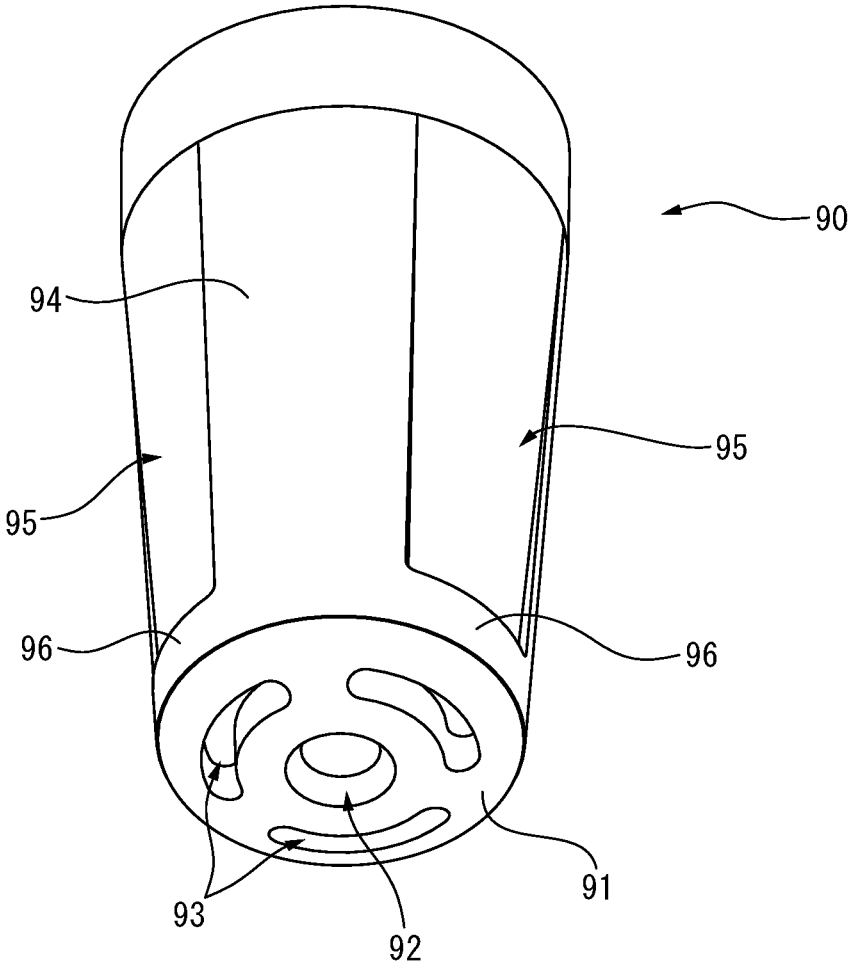
FIG. 22 is a perspective view of a cover member of the knock type writing instrument of FIG. 1.
Figure 23:
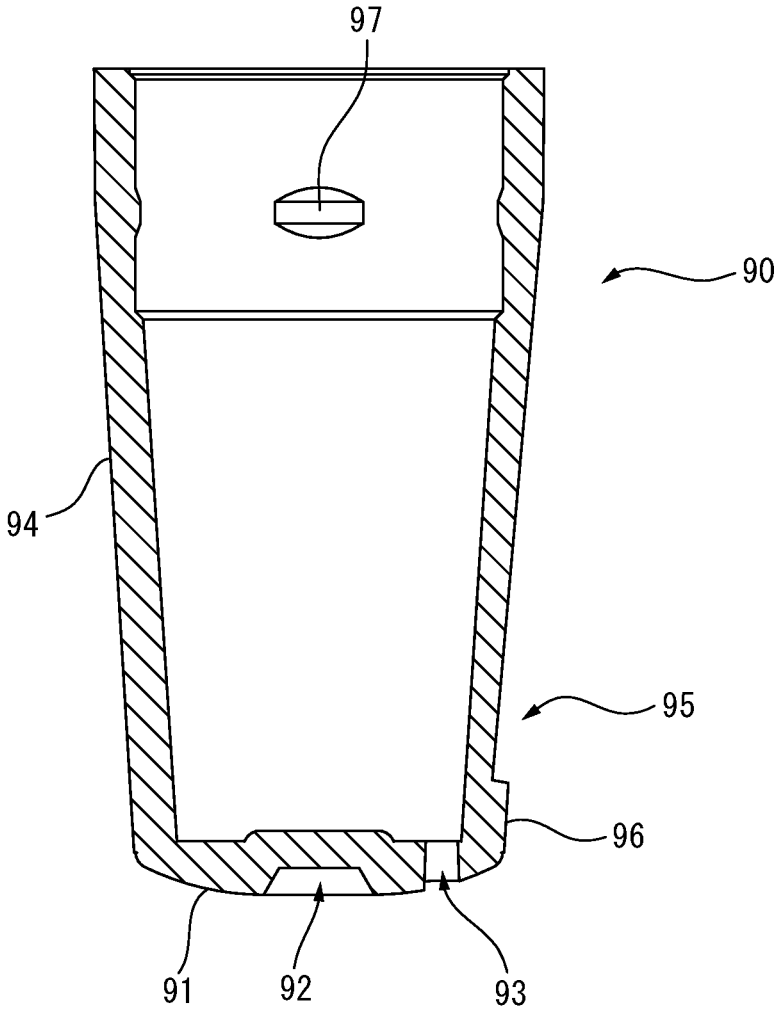
FIG. 23 is a longitudinal cross-sectional view of the cover member of the knock type writing instrument of FIG. 1.

FIG. 22 is a perspective view of the cover member 90 of the knock type writing instrument 1, while FIG. 23 is a longitudinal cross-sectional view of the cover member 90 of the knock type writing instrument 1. In FIG. 22 and FIG. 23, the upper parts are the front side of the knock type writing instrument 1. The cover member 90 fits with the holding member 80 in a detachable manner.

The cover member 90 has an external shape of a frustoconical shape. The top surface 91 constituted by the front end of the cover member 90 of is formed into a gentle dome shape. At the center part of the top surface 91, a circular recessed part 92 is formed. Around the circular recessed parts 92, three arc shaped arc openings 93 running down to the inside of the cover member 90 are formed at equal intervals along the circumferential direction. By arc openings 93 being formed at the top surface 91 of the cover member 90, even if the cover member 90 is mistakenly ingested by a toddler etc., it will not block the airway thereby enabling safety to be secured.

At the conical side surface 94 of the cover member 90, three trapezoidal shaped shallow recessed parts 95 are formed at equal intervals along the circumferential direction. The recessed parts 95 are deeper just slightly at the backs than at the fronts. As a result, at the parts of the side surface 94 between the top surface 91 and the recessed parts 95, projecting parts 96 are defined projecting outward in the radial direction. At the inner circumferential surface of the cover member 90, mating projections 97 are formed. The mating projections 97 fit with the corresponding ring-shaped projection 84 of the holding member 80 whereby the cover member 90 is attached to the holding member 80. In the attached state, the front end surface of the cover member 90 abuts against the back end surface of the flange part 83 of the holding member 80. When detaching the cover member 90 if using the erasing member 70 etc., a finger can catch against the projecting parts 96, so the cover member 90 can be easily detached without the finger slipping.

The erasing member 70 is covered by the cover member 90 other than at the time of use, so it is possible to prevent the erasing member 70 from becoming dirty. The cover member 90 may also be formed transparent or translucent. Due to this, in the state where the erasing member 70 is covered by the cover member 90, it becomes possible to easily visually confirm the state of wear of the erasing member 70.

Note that, at the back end part of the front barrel 3, an erasing member may be provided integrally with or separately from the front barrel 3. In this case, at the time of use of the erasing member, the back barrel 4 is detached to enable use. The erasing member is covered by the back barrel 4 as a cover member as well other than at the time of use, so it becomes possible to prevent the erasing member from becoming dirty. Furthermore, by formation of the back barrel 4 by a transparent or translucent material, it becomes possible to easily visually confirm the state of wear of the erasing member provided at the back end part of the front barrel 3.

The erasing member 70 and cover member 90 are always arranged at the positions such as shown in FIG. 5, that is, the retraction limits, both when the knock type writing instrument 1 is in the writing state and is in the nonwriting state. In relation to this, as explained above, the erasing member 70 is attached to the operating part 20 through the holding member 80, so the operating part 20, erasing member 70, holding member 80, and cover member 90 move as one piece.

As shown in FIG. 5, inside the hollow mating part 26 of the operating part 20, an elastic member of a biasing spring 7 is arranged. One end of the biasing spring 7 is supported by the back end surface of the small diameter part 30*b* of the main rotor 30 and biases the operating part 20 backward. Due to this, the erasing member 70 and cover member 90 are always arranged at the same positions in the axial direction, that is, the retracted positions, both when the knock type writing instrument 1 is in the writing state and is in the nonwriting state. In other words, the main rotor 30 is arranged in the front or back according to the state of the knock type writing instrument 1, but whatever the position, the length or spring constant of the biasing spring 7 is set so as to always bias the operating part 20 backward.

The erasing member 70 is always at the limit position of retraction, so the amount of projection of the erasing member 70 from the back end part of the barrel 2 is the same in both the nonwriting state and the writing state. Therefore, when erasing writing by the knock type writing instrument 1 using the erasing member 70, both in the writing state and in the nonwriting state, it is possible to equally view the erasing member 70. As a result, it is possible to easily target an intended location and possible to accurately perform a rubbing operation.

Figure 24:
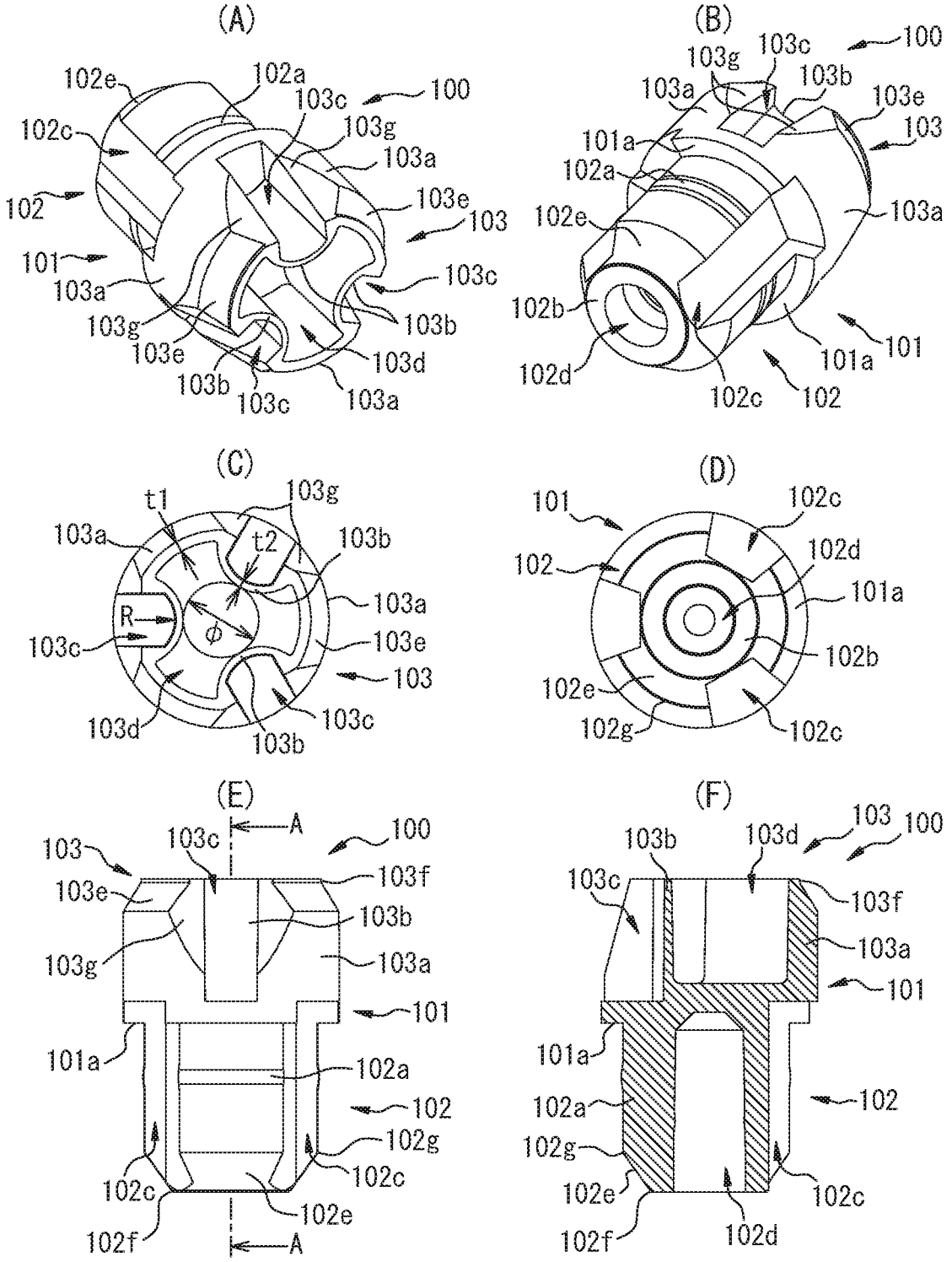
FIGS. 24A to 24F are views of a refill cap of the knock type writing instrument of FIG. 1.

FIGS. 24A to 24F are views of a refill cap 100 of the knock type writing instrument 1. FIG. 24A is a perspective view of the refill cap 100, FIG. 24B is another perspective view of the refill cap 100, FIG. 24C is a plan view of the refill cap 100, FIG. 24D is a bottom view of the refill cap 100, FIG. 24E is a side view of the refill cap 100, and FIG. 24F is a longitudinal cross-sectional view along the line A-A of FIG. 24E of the refill cap 100.

The refill cap 100 is comprised of an abutting part 101 exposed from the back end part of the refill 5 and abutting against the inner wall of the back barrel etc. and a press-fitting part 102 as a part which is press-fit into the refill 5. A front end surface 101*a* of the abutting part 101 is configured so as to abut against the back end surface of the refill 5. Further, the abutting part 101 has an elastic deformation part 103. The elastic deformation part 103 has a plurality of thick parts 103*a* extending toward the back and thick in the radial direction and thin parts 103*b* thinner in the radial direction than the thick parts 103*a*.

The thick parts 103*a* exhibit cross-sections vertical to the center axis, that is, transverse cross-sections, of substantially fan shapes and are equally arranged at 120 degrees about the center axis. At the outer circumferential surfaces of the back end parts of the thick parts 103*a*, tapered surfaces 103*e* are formed, and due to this, the back end surfaces of the thick parts 103*a* exhibit substantially arc shapes having the center axis as the centers of the arcs. Between the tapered surfaces 103*e* and the back end surfaces of the thick parts 103*a*, straight parts 103*f* (FIG. 24E and FIG. 24F) are formed comprised of parts of the cylindrical surfaces having the center axis as their axes. Due to the straight parts 103*f*, the effect is exhibited that shaping by an injection mold becomes easy.

The thin parts 103*b* connect the thick parts 103*a* in the circumferential direction at parts close to the center axis and have transverse cross-sections of substantially arc shapes with centers of arcs arranged outward in the radial direction. That is, the thick parts 103*a* and the thin parts 103*b* are alternately arranged. Due to this, the back end surface of the elastic deformation part 103, when considering the circle including the back end surfaces of the thick parts 103*a*, exhibits a shape forming the substantially arc shaped back end surfaces of the thin parts 103*b* by inversion about the end points of the arcs facing the adjoining thick parts 103*a*. The thin parts 103*b* are formed to substantially uniform thicknesses across the center axis direction.

Due to the thick parts 103*a* and the thin parts 103*b* between the same, channel-shaped air flow grooves 103*c* are formed. Further, at the back end surface of the elastic deformation part 103, near the center axis, a free space, constituted by a hole 103*d*, is formed for enabling elastic deformation of the elastic deformation part 103 due to the thick parts 103*a* or thin parts 103*b*. In the hole 103*d*, the shape defined by the inside edge of the back end surface of the above-mentioned elastic deformation part 103 is a shape extending along the center axis direction whereby an internal space is defined. Therefore, the hole 103*d* is defined by the connected inner surfaces of the thick parts 103*a* and inner surfaces of the thin parts 103*b*, so the inside space of the hole 103*d* is defined by a series of surfaces. The facing edges of the adjoining thick parts 103*a* are gouged out so as to form parts of conical surfaces straddling the air flow grooves 103*c* to thereby form the curved surfaces 103*g*.

The press-fitting part 102 is comprised of a substantially columnar shape with a diameter smaller than the abutting part 101. The press-fitting part 102 has a plurality of mating projections 102*a* formed in the circumferential direction. When press-fitting it to the back end part of the refill 5, the mating projections 102*a* elastically deform slightly inward in the radial direction thereby realizing a more reliable mated state with the inner walls of the refill 5. Further, at the press-fitting part 102, three air passage grooves 102*c* extending from the front end surface 102*b* in parallel with the center axis backward are formed at that side surface part. The air passage grooves 102*c* are equally arranged at 120 degree intervals about the center axis, and this arrangement is offset exactly 60 degrees about the center axis from the arrangement of the air flow grooves 103*c* of the elastic deformation part 103. The cross-sectional shapes of the air passage grooves 102*c* at a plane vertical to the center axis are substantially rectangular. Further, the air passage grooves 102*c* extend further backward over the press-fitting part 102, that is, over the front end surface 101*a* of the abutting part 101. For example, in the refill cap 100 shown in FIGS. 24A to 24F, the air passage grooves 102*c* extend backward from the front end surface 101*a* of the abutting part 101 by exactly the same length as the radial direction depth of the air passage grooves 102*a* of the press-fitting part 102.

Furthermore, at the front end surface of the press-fitting part 102, a hole 102*d* is formed, and due to this, sink marks at the time of shaping by a mold are prevented. Furthermore, at the outer circumferential surface of the front end part of the press-fitting part 102, a tapered surface 102*e* is formed, and due to this, press-fitting to the back end part of the refill 5 becomes easy. The angle of the tapered surface 102*e* with respect to the center axis is, for example, about 45 degrees. Further, at the front end surface 102*b*, a straight part 102*f* (FIG. 24E and FIG. 24F) comprised of a cylindrical shape having the center axis as its axis is formed. Due to the straight part 102*f*, the effect is exhibited that shaping by an injection mold becomes easier. Further, at the back end part of the tapered surface 102*e*, a roundly chamfered curved surface 102*g* is formed whereby insertion in the back end part of the refill 5 is facilitated.

In the plan view of FIG. 24C, if the thickness of the thinnest parts of the thick parts 103*a*, that is, in the radial direction near the back end part, that is, the wall thickness, is t1 and the wall thickness of the thin parts 103*b* is t2, t1 is preferably in the range of 0.2 mm to 1.0 mm while t2 is preferably in the range of 0.1 mm to 0.5 mm. In other words, t1 is preferably within a range of 2 to 10 times t2. Further, if the diameter of the inscribed circle of the hole 103*d*, that is, the circle contacting the inner surfaces of the thin parts 103*b*, is φ, φ is preferably in the range of 1.5 mm to 3.0 mm. Further, if the radii of curvature of the inner surface sides of the substantially arc shaped thin parts 103*b*, that is, the sides facing the hole 103*d*, are R, R is preferably in the range of 1.0 mm to 2.0 mm. Further, R is preferably smaller than φ.

If fitting the refill cap 100 with the back end part of the refill 5, the air passage grooves 102*c* and the inner wall of the back end part of the refill 5 and back end surface of the refill 5 cooperate to form air flow passages. The air flow passages connect the inside and outside of the refill 5 in the state attaching the refill cap 100 to the refill 5. That is, at the front end surface of the refill cap 100 or the side surface part of the refill cap 100, opening parts forming the outlet and inlet of the air flow passages are formed.

The refill cap 100 can be used in other writing instruments having refills. In this case, known in the art is a writing instrument in which mating parts are formed at the inner wall of the back end part of the back barrel and in which the mating parts and back end part of the refill cap 100 abut. That is, if placing the refill 5 to which the refill cap 100 has been attached inside the barrel, the back end parts of the thick parts 103*a* of the elastic deformation part 103 of the refill cap 100 are compressed by the mating parts at the inner wall of the back end part of the back barrel. Due to this, the thick parts 103*a* elastically deform toward the center axis, that is, to the inside in the radial direction. At the same time as this, the thin parts 103*b* between the thick parts 103*a* also elastically deform so as to be compressed in the circumferential direction, that is, so that the arcs in the transverse cross-sections flex.

Due to the elastic deformation of these members, the thick parts 103*a* push against and engage with the inner wall of the barrel whereby the refill 5 is fastened. Furthermore, due to the elastic deformation of these members, it becomes possible to absorb variations in dimensions in the axial direction occurring at the time of production of the refill 5. Further, the load directly applied to the thick parts 103*a* is also supported by the thin parts 103*b*, so overall the load on the refill cap 100 can be dispersed to the elastic deformation part 103 as a whole. Further, by connecting the thick parts 103*a* by the thin parts 103*b*, occurrence of elastic fatigue of the thick parts 103*a* can also be suppressed.

Further, the hole 103*d* of the elastic deformation part 103 of the refill cap 100 is not circular, but is noncircular in transverse cross section. In particular, it is formed in a noncircular shape having recessed parts oriented toward the center axis by the inner walls of the thin parts 103*b*, and therefore, the elastic deformation part 103 can be made to easily deform. That is, it becomes possible to provide a refill 5 which secures air flow passages between the inside and outside of the refill 5 while relatively easily deforming and thereby not requiring strong force at the time of assembly and a writing instrument provided with a refill 5.

The refill cap 100, as explained above, abuts against the inner wall of the back end part of the back barrel and elastically deforms, so is preferably formed by a material softer than the barrel, that is, the back barrel. For example, if the barrel is formed by polycarbonate or ABS, the refill cap 100 is formed by polypropylene, polyacetal, a thermoplastic elastomer, etc. softer than these.

The refill 5 has opening parts forming the outlets and inlets of the air flow passages of the side surface part of the refill cap 100 as explained above. Therefore, the air flow passages will never deform. For that reason, according to the refill 5, it becomes possible to sufficiently secure air flow passages between the inside and outside of the refill 5.

Further, according to the refill 5, the press-fitting part 102 of the refill cap 100 is provided with air passage grooves 102*c*. For this reason, the mating projections 102*a* compressed inward in the radial direction due to the press-fitting expand in the circumferential direction at the parts of the air passage grooves 102*c* in accordance with the compression. Due to this, the force acting outward in the radial direction so as to cause cracks in the refill body is eased. Therefore, according to the refill 5, it becomes possible to maintain a sufficient mating force between the refill 5 and the refill cap 100 while suppressing cracking of the refill 5.

The elastic deformation part 103 can be formed integrally with the refill 5. If the elastic deformation part 103 is formed integrally with the refill 5, the air flow passages may also simply be holes provided at the side surface part. Note that, the number of the equally arranged thick parts 103*a* is not particularly limited. Further, the shapes of the air passage grooves 102*c* and the number of the same, that is, the number of air flow passages, may be any shapes and numbers.

In summary, the tubular refill 5 to which the refill cap 100 is attached is provided with a tip part, a back end part, a writing part provided at the tip part, and a refill cap attached to the back end part. Further, it is provided with air flow passages connecting the inside and outside of the refill. An opening part connecting from the outside of the refill to the inside of the air flow passages is provided at a side surface part of the back end part or a side surface part of the refill cap. Near the center axis of the back end surface of the refill cap, a hole with a noncircular shape in transverse cross-section is formed.

Further, the noncircular shape may also have recessed parts oriented toward the center axis. Further, at the side surface part of the refill cap, air passage grooves may be provided in the center axis direction, and at the time of attachment of the refill cap, the air passage grooves and the inner wall of the back end part may form the air flow passages. Further, the refill cap may also have an elastic deformation part provided with a plurality of thick parts thick in the radial direction and thin parts connecting the thick parts in the circumferential direction and thinner in the radial direction than the thick parts, and the inner surfaces of the thick parts and the inner surfaces of the thin parts may form the hole. Note that, the thickness (t1) of the thinnest parts of the thick parts is preferably in the range of 2 times to 10 times the thickness (t2) of the thin parts. The radius of curvature (R) of the thin parts forming the recessed parts is preferably smaller than the diameter (φ) of the inscribed circle of the hole. Further, at the outer circumferential surface of the front end part of the refill cap, a tapered surface may also be formed. Further, a barrel and a refill housed in the barrel may also be provided and the refill cap may be engaged with engaging parts inside the barrel when placing the refill inside the barrel.

Figure 25:
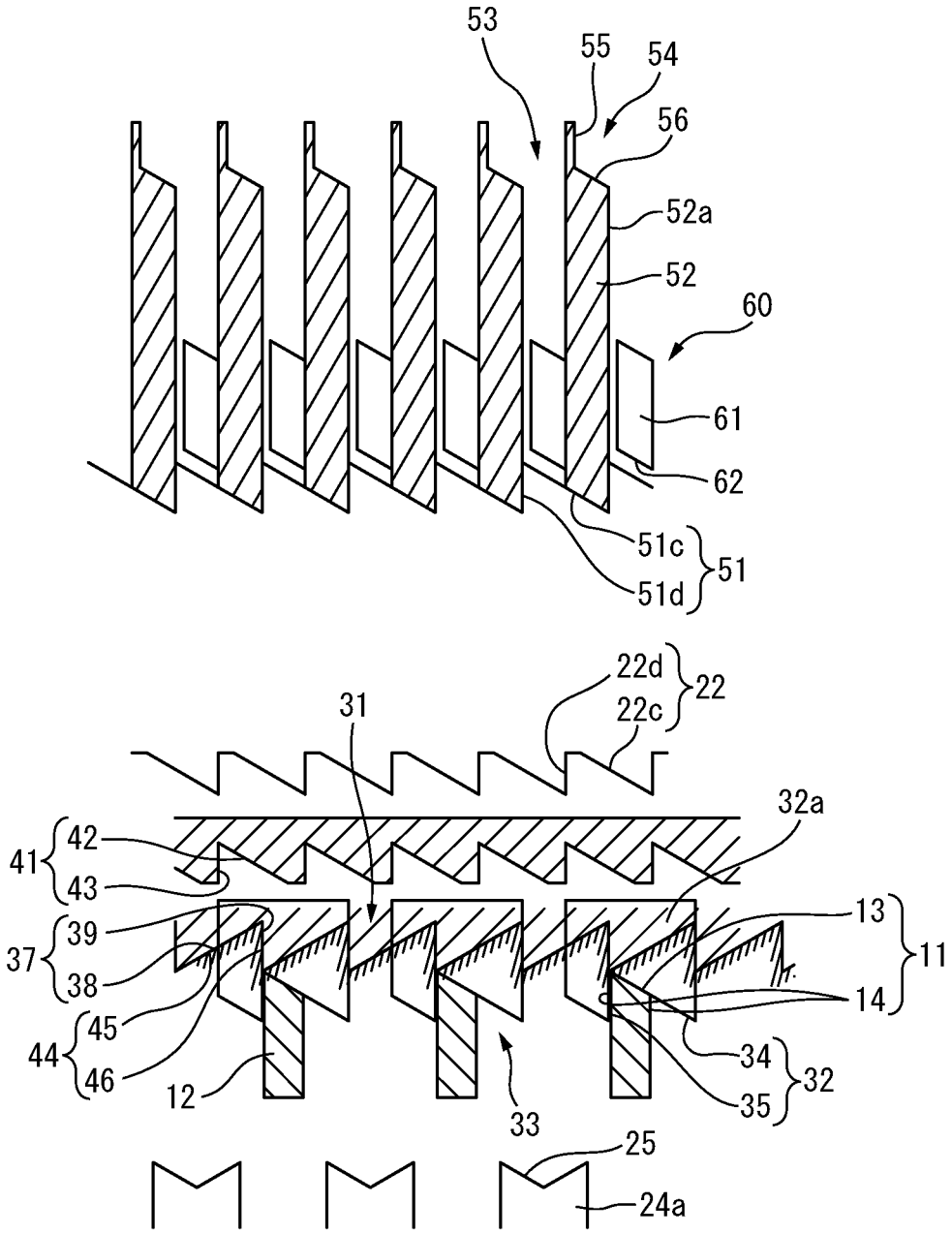
FIG. 25 is a schematic view showing a relationship of different cams of the knock type writing instrument of FIG. 1.

FIG. 25 is a schematic view showing the relationship among the cams of the knock type writing instrument 1. That is, FIG. 25 is a schematic view showing the positional relationship among the external cam 11 of the inner tube 10, the operating part 20, the main rotor 30, the speed reducing rotor 40, the knock lock member 50, and the locking part 60 in the writing state of the knock type writing instrument 1 and the state where the front end is turned downward. In more detail, it shows the positions of the lock cam face 22 and V-shaped cam faces 25 of the operating part 20, the cam receiving surface 33 and speed reducing cam face 37 of the main rotor 30, the first speed reducing cam receiving surface 41 and second speed reducing cam receiving surface 44 of the speed reducing rotor 40, the lock cam receiving surface 51 and the first projecting parts 52 of the knock lock member 50, and the locking part 60 of the barrel 2 with respect to the external cam 11 laid open in the circumferential direction.

However, the speed reducing cam face 37 of the main rotor 30 and the second speed reducing cam receiving surface 44 of the speed reducing rotor 40 are arranged inward in the radial direction from the other cams, however, for convenience, in FIG. 25, are similarly shown at corresponding positions in the axial direction. In FIG. 25, the upper part is the front side of the knock type writing instrument 1, while the lower part is the back side of the knock type writing instrument 1. Further, in FIG. 25, the front end of the knock type writing instrument 1 is turned downward, so gravity acts upward in the figure.

In the writing state of the knock type writing instrument 1, the internal cam 32 engages with the external cam 11, and due to this, the writing state is maintained. That is, the slanted surfaces 34 and the vertical wall surfaces 35 of the cam receiving surface 33 of the internal cam 32 engage with the slanted surfaces 13 and the vertical wall surfaces 14 of the projecting parts 12 of the external cam 11 whereby retraction and rotation of the main rotor 30 are restricted. At this time, the speed reducing cam face 37 of the main rotor 30 and the second speed reducing cam receiving surface 44 of the speed reducing rotor 40 intermesh. Further, while explained later in detail, the front end of the knock type writing instrument 1 is turned downward, so the knock lock member 50 moves forward and does not lock with the locking part 60. That is, the knock operation can be performed without movement of the operating part 20 being restricted.

FIGS. 26A to 26F are schematic views showing the switching from the writing state to the nonwriting state of the knock type writing instrument 1. The main rotor 30 is given a rotational force by the above-mentioned cam mechanism of the V-shaped cam faces 25 of the operating part 20 and the cam receiving surface 33 of the main rotor 30 and moves from the left to the right in the figure at every knock operation. Note that, the schematic views of FIGS. 26A to 26F are similar to the schematic views of FIGS. 25A to 25F except that for convenience, the speed reducing cam face 37 of the main rotor 30 and the second speed reducing cam receiving surface 44 of the speed reducing rotor 40 are shown offset downward in the figure.

Figure 26:
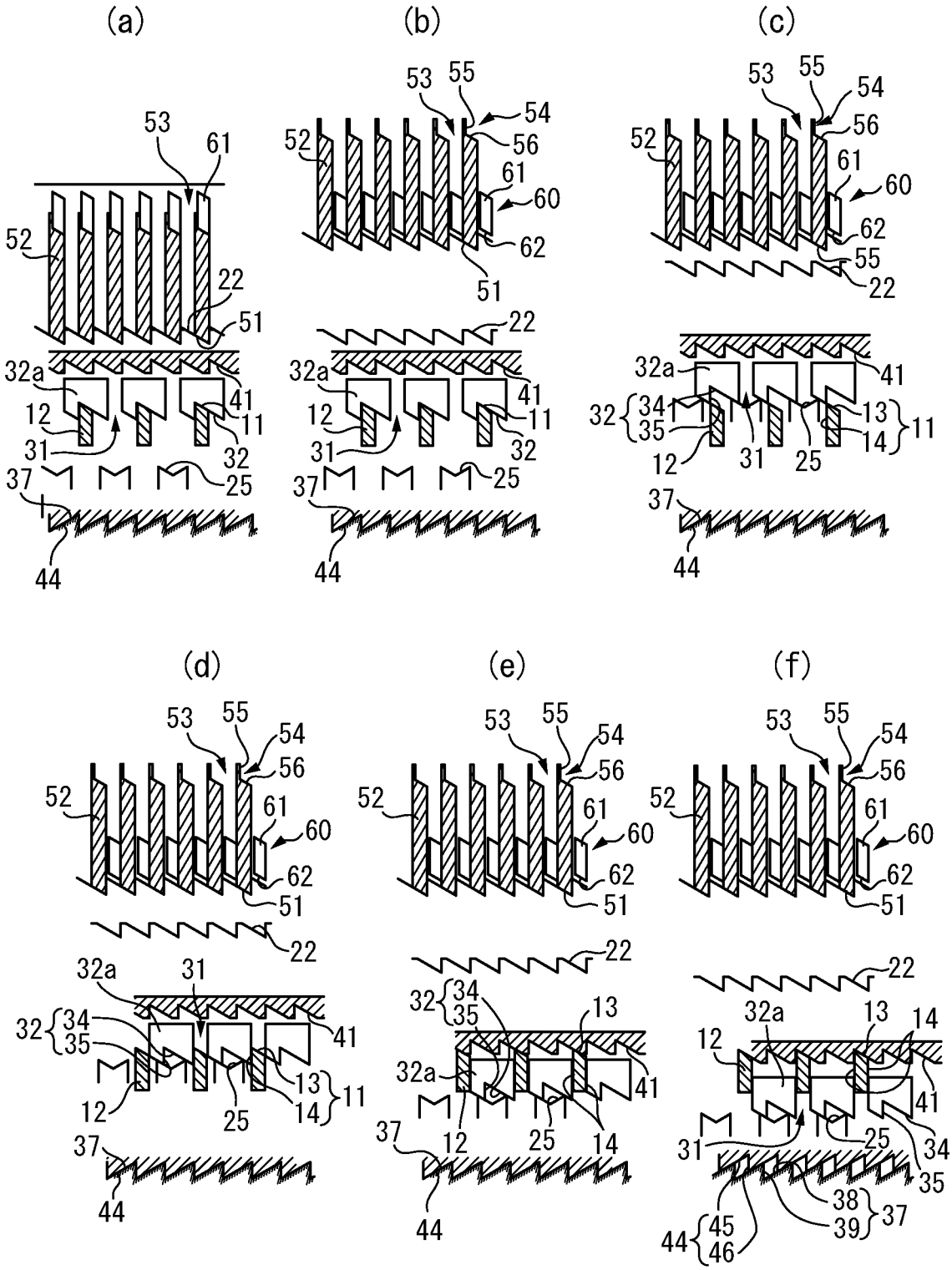
FIGS. 26A to 26F are schematic views showing switching of the knock type writing instrument of FIG. 1 from a writing state to a nonwriting state.

FIG. 26A is a schematic view showing the writing state of the knock type writing instrument 1 and the state where the front end is turned upward. It is the state of the knock type writing instrument 1 shown in FIG. 1. The speed reducing cam face 37 of the main rotor 30 and the second speed reducing cam receiving surface 44 of the speed reducing rotor 40 intermesh. The difference from the state of the knock lock member 50 shown in FIG. 25 is the position of the knock lock member 50. That is, in FIG. 26A, the front end of the knock type writing instrument 1 is turned upward, so gravity acts downward in the figure.

By turning the front end of the knock type writing instrument 1 up, the knock lock member 50 moves backward and abuts against the operating part 20. The knock lock member 50, as explained above, receives the force component of the circumferential direction due to its own weight and rotates about the center axis. That is, the lock cam face 22 of the operating part 20 and the lock cam receiving surface 51 of the knock lock member 50 cooperate to make the knock lock member 50 rotate about the center axis. As a result of that rotation, the knock lock member 50 locks with the locking part 60 so movement of the operating part 20 forward is inhibited.

In more detail, by the second projecting parts 61 of the locking part 60 being held in the recessed parts 54 of the first projecting parts 52 of the knock lock member 50, the knock lock member 50 and the locking part 60 become locked. In other words, the recessed parts 54 are configured so as to become complementary shapes with parts of the second projecting parts 61 of the locking part 60 so that the second projecting parts 61 of the locking part 60 are held in the recessed parts 54 of the first projecting parts 52 of the knock lock member 50 in the writing state. Therefore, the slanted surfaces 62 of the second projecting parts 61 have the same slants as the slanted surfaces 56 of the recessed parts 54. In this state, even if strongly pushing against the operating part 20 and making it move forward, the force component in the direction in which the second projecting parts 61 of the locking part 60 are housed inside the recessed parts 54 of the knock lock member 50 just becomes stronger. The locked state is not released.

FIG. 26B is a schematic view showing the writing state of the knock type writing instrument 1 and the state where the front end is turned downward and a schematic view of the state of the knock type writing instrument 1 shown in FIG. 2. Therefore, gravity acts upward in the figure. By turning the front end of the knock type writing instrument 1 downward, the knock lock member 50 is freed from the operating part 20. On the other hand, the knock lock member 50 pushes against the locking part 60 through the first projecting parts 52 due to its own weight. That is, due to the weight of the knock lock member 50, the slanted surfaces 56 of the recessed parts 54 of the first projecting parts 52 receive the force component of the circumferential direction from the slanted surfaces 62 of the second projecting parts 61 of the locking part 60. As a result, the knock lock member 50 rotates about the center axis opposite to the case of FIG. 26A and the second projecting parts 61 are guided into the guide grooves 53. That is, the locked state of the knock lock member 50 and the locking part 60 is released and movement of the operating part 20 forward becomes possible. The movement of the knock lock member 50 forward stops by the member abutting against the back end surface of the front barrel 3.

FIG. 26C is a schematic view showing the state while shifting to nonwriting state of the knock type writing instrument 1 and where the front end is turned downward. Therefore, gravity acts upward in the figure. If the operating part 20 is pushed against the biasing force of the spring 6 and biasing spring 7 and the operating part 20 is made to move forward, the V-shaped cam faces 25 of the operating part 20 abut against the slanted surfaces 34 of the cam receiving surface 33 of the main rotor 30 and the main rotor 30 and speed reducing rotor 40 move forward. Due to this, the back end parts of the vertical wall surfaces 35 of the cam receiving surface 33 of the internal cam 32 ride over the front end parts of the projecting parts 12 of the external cam 11 in the front-back direction. At this time, the slanted surfaces 34 of the cam receiving surface 33 of the main rotor 30 and the slanted surfaces 13 of the external cam 11 match and the restriction on the rotation of the main rotor 30 about the center axis due to the vertical wall surfaces 14 of the projecting parts 12 of the external cam 11 is released. The speed reducing cam face 37 of the main rotor 30 and the second speed reducing cam receiving surface 44 of the speed reducing rotor 40 intermesh.

If the pushing action of the operating part 20 is released from the state of FIG. 26C, the operating part 20, main rotor 30, and speed reducing rotor 40 retract due to the biasing force of the spring 6. At this time, the rotation of the main rotor 30 about the center axis is not restricted by the vertical wall surfaces 14 of the projecting parts 12 of the external cam 11. For that reason, due to the biasing force of the spring 6 through the refill 5 and speed reducing rotor 40, the slanted surfaces 34 of the cam receiving surface 33 of the main rotor 30 push against the slanted surfaces 13 of the external cam 11 or the V-shaped cam faces 25 of the operating part 20 and the main rotor 30 receives the force component of the circumferential direction and rotates about the center axis (counterclockwise when viewing the knock type writing instrument 1 from the front).

The main rotor 30 retracts while rotating, so, as shown in FIG. 26D, the projecting parts 32*a* of the internal cam 32 are arranged between the projecting parts 12 of the external cam 11 while the projecting parts 12 of the external cam 11 are arranged between the projecting parts 32*a* of the internal cam 32, that is, inside the vertical grooves 31. As a result, the engagement between the external cam 11 and the internal cam 32 is released.

If the operating part 20, main rotor 30, and speed reducing rotor 40 strongly retract together further, right before finishing switching to the nonwriting state of the knock type writing instrument 1, that is, during movement of the refill 5 backward, in the present embodiment, right before movement of the refill 5 backward stops, as shown in FIG. 26E, the slanted surfaces 42 of the first speed reducing cam receiving surface 41 of the speed reducing rotor 40 abut against the slanted surfaces 13 of the external cam 11.

If, in the state of FIG. 26E, due to the biasing force of the spring 6 through the refill 5, the slanted surfaces 42 of the first speed reducing cam receiving surface 41 of the speed reducing rotor 40 push against the slanted surfaces 13 of the external cam 11, the speed reducing rotor 40 receives the force component of the circumferential direction and rotates about the center axis. That is, during movement of the refill 5 backward, the slanted surfaces 13 of the external cam 11 cooperate with the first speed reducing cam receiving surface 41 of the speed reducing rotor 40 and make the speed reducing rotor 40 rotate about the center axis. In other words, the slanted surfaces 42 of the first speed reducing cam receiving surface 41 of the speed reducing rotor 40 slide with respect to the slanted surfaces of the slanted surfaces 13 of the external cam 11. That is, during movement of the refill 5 backward, in the speed reducing rotor 40, the first speed reducing cam receiving surface 41 acts with the external cam 11 and the speed reducing rotor 40 rotates while moving backward. Further, simultaneously with this sliding, the slanted surfaces 45 of the second speed reducing cam receiving surface 44 of the speed reducing rotor 40 slide with respect to the slanted surfaces 38 of the speed reducing cam face 37 of the main rotor 30 and the intermeshing of the speed reducing cam face 37 of the main rotor 30 and the second speed reducing cam receiving surface 44 of the speed reducing rotor 40 is released.

The rotation of the speed reducing rotor 40 stops by the vertical wall surfaces 43 of the first speed reducing cam receiving surface 41 striking the vertical wall surfaces 14 of the projecting parts 12 of the external cam 11. Note that, the rotational direction of the speed reducing rotor 40 is the same as the rotational direction of the main rotor 30.

FIG. 26F is a schematic view showing the state where the rotation of the speed reducing rotor 40 stops and the nonwriting state has finished being switched to, that is, the state where movement of the refill 5 backward has stopped, and a schematic view of the state of the knock type writing instrument 1 shown in FIG. 3. At this time, the slanted surfaces 42 and the vertical wall surfaces 43 of the first speed reducing cam receiving surface 41 engage with the slanted surfaces 13 and the vertical wall surfaces 14 of the projecting parts 12 of the external cam 11 whereby retraction and rotation of the speed reducing rotor 40 are restricted. For that reason, the retraction of the operating part 20 and main rotor 30 are also similarly restricted. Since the retraction of the operating part 20, main rotor 30, and speed reducing rotor 40 is restricted, retraction of the refill 5 is also restricted. As a result, the nonwriting state of the knock type writing instrument 1 is maintained.

From the writing state of the knock type writing instrument 1 shown in FIG. 26A, and, as shown in FIG. 26F, until the slanted surface 42 of the speed reducing rotor 40 abuts against the slanted surfaces 13 of the external cam 11, the speed reducing cam face 37 of the main rotor 30 and the second speed reducing cam receiving surface 44 of the speed reducing rotor 40 intermesh. On the other hand, as explained above, during movement of the refill 5 backward, the speed reducing rotor 40 rotates whereby the intermeshing of the speed reducing cam face 37 of the main rotor 30 and the second speed reducing cam receiving surface 44 of the speed reducing rotor 40 is released.

The rotation of the speed reducing rotor 40, in other words, the sliding of the slanted surfaces 42 of the first speed reducing cam receiving surface 41 of the speed reducing rotor 40 with respect to the slanted surfaces 13 of the external cam 11 and the sliding of the slanted surfaces 45 of the second speed reducing cam receiving surface 44 of the speed reducing rotor 40 with respect to the slanted surfaces 38 of the speed reducing cam face 37 of the main rotor 30, are performed against the frictional resistance between these slanted surfaces. That is, at the time of switching to the nonwriting state, the refill 5 moves strongly backward due to the biasing force of the spring 6, but during movement of the refill 5 backward, part of that kinetic energy is converted to kinetic energy due to the rotation of the speed reducing rotor 40 and the heat of friction generated due to the sliding of the above-mentioned slanted surfaces. As a result, the impact applied at the time when the refill 5 stops is reduced and eased by exactly the amount of kinetic energy due to rotation and kinetic energy converted to heat of friction.

In general, in a knock type writing instrument, when switching from the writing state to the nonwriting state, sometimes the impact given to the refill ends up causing air bubbles to form in the ink in the refill. That is, when switching from the writing state to the nonwriting state, the refill moves strongly to the back due to the biasing force of the spring, and impact is applied when stopped. In particular, if the refill holds low viscosity ink or shear reducing viscous ink, that impact causes the ink to retract and causes the possibility of air entering into the refill from the writing part. In this case, air bubbles are liable to form in the ink and poor writing performance is liable to be caused. (Note that, the phenomenon of the ink retracting and thereby air entering into the refill will be referred to as "ink-back" below)

Therefore, as explained above, during movement of the refill 5 backward at the time of switching to the nonwriting state, it is possible to reduce that kinetic energy to thereby always ease the impact applied to the refill 5, and due to this, it is possible to prevent the occurrence of ink-back.

Further, the ink-back occurring as a result of the impact applied to the refill 5 easily occurs due to the impact in the front-back direction, in particular, applied due to the refill 5 stopping, but by applying impact in a direction different from that simultaneously, occurrence of ink-back can be suppressed. Specifically, the impact at the time of making rotation of the speed reducing rotor 40 stop, that is, the impact when the vertical wall surfaces 43 of the first speed reducing cam receiving surface 41 strike the vertical wall surfaces 14 of the projecting parts 12 of the external cam 11 in the circumferential direction, can be utilized.

Furthermore, a space closed by the main rotor 30 and the speed reducing rotor 40, that is, a substantially sealed space, is formed. In more detail, a space S is defined between the inner circumferential surface of the hole 36 of the main rotor 30 and the medium diameter part 40*b* and small diameter part 40*c* of the speed reducing rotor 40 inserted in the hole 36. Due to the above-mentioned rotation of the speed reducing rotor 40 with respect to the main rotor 30 and the change of the intermeshing of the speed reducing cam face 37 of the main rotor 30 and the second speed reducing cam receiving surface 44 of the speed reducing rotor 40 due to the rotation of the speed reducing rotor 40, the volume of the space S changes, that is, compression and expansion are performed. Due to the change in volume of the space S, the inside pressure complicatedly changes, and due to this, during movement of the refill 5 backward, a damper effect reducing the speed of movement of the refill 5 is generated. As a result, the impact applied at the time of stopping the refill 5 can be eased.

The knock type writing instrument 1, as explained above, has a biasing spring 7 supported at one end by the main rotor 30 inside of the hollow mating part 26 of the operating part 20, but the biasing spring 7 also exhibits the effect of easing the impact applied when the refill 5 stops.

FIGS. 27A to 27F are schematic views showing switching from the nonwriting state to the writing state of the knock type writing instrument 1. The schematic views of FIGS. 27A to 27F are schematic views similar to FIGS. 26A to 26F. In the figures, the upper parts show the front side of the knock type writing instrument 1, while the lower parts show the back side of the knock type writing instrument 1.

Figure 27:
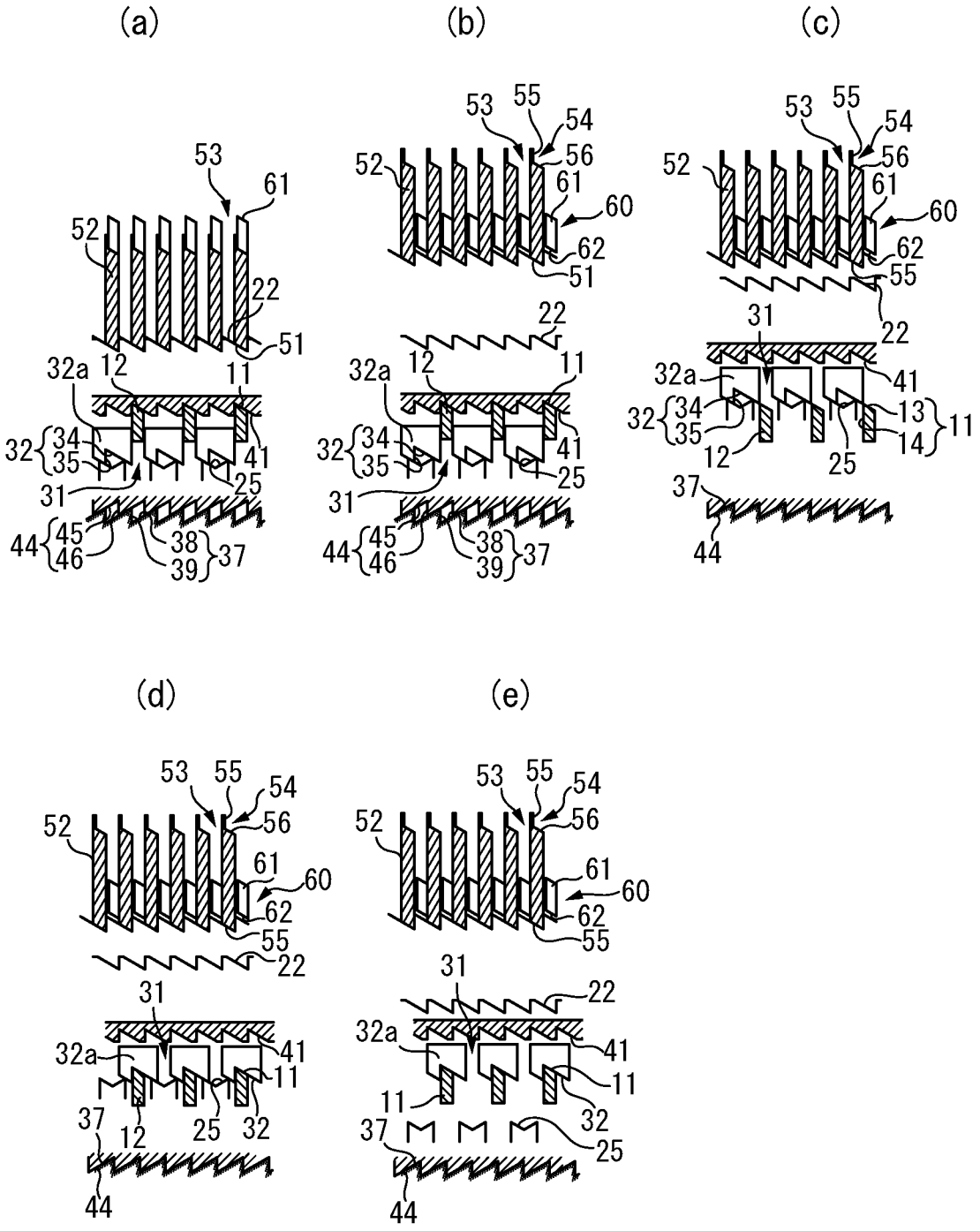
FIGS. 27A to 27E are schematic views showing switching of the knock type writing instrument of FIG. 1 from the nonwriting state to the writing state.

FIG. 27A is a schematic view showing the nonwriting state of the knock type writing instrument 1 and the state where the front end is turned upward and a schematic view of the state of the knock type writing instrument 1 shown in FIG. 4. The speed reducing cam face 37 of the main rotor 30 and the second speed reducing cam receiving surface 44 of the speed reducing rotor 40 do not intermesh, as explained above, while referring to FIG. 26E and FIG. 26F. Gravity acts downward in the figure. For that reason, while referring to FIG. 26A, as explained above, the knock lock member 50 locks with the locking part 60 and movement of the operating part 20 forward is obstructed. That is, the schematic view of FIG. 27A is similar to the schematic view of FIG. 26F other than the knock lock member 50 locking with the locking part 60.

FIG. 27B is a schematic view showing the nonwriting state of the knock type writing instrument 1 and the state where the front end is turned downward and a schematic view of the state of the knock type writing instrument 1 shown in FIG. 3. Therefore, gravity acts upward in the figure. By turning the front end of the knock type writing instrument 1 downward, while referring to FIG. 26B, as explained above, the locked state of the knock lock member 50 and the locking part 60 is released and movement of the operating part 20 forward becomes possible.

FIG. 27C is a schematic view showing the state when shifting to the writing state of the knock type writing instrument 1 and the state where front end is turned downward. Therefore, gravity acts upward in the figure. If pushing the operating part 20 against the biasing force of the spring 6 and biasing spring 7 and making the operating part 20, main rotor 30, and speed reducing rotor 40 move forward, the speed reducing rotor 40 rotates about the center axis. That is, before pushing the operating part 20, the speed reducing cam face 37 of the main rotor 30 and the second speed reducing cam receiving surface 44 of the speed reducing rotor 40 do not intermesh. That is, the phase is off, so the second speed reducing cam receiving surface 44 of the speed reducing rotor 40 receives the force component of the circumferential direction from the speed reducing cam face 37 of the main rotor 30. As a result, the speed reducing rotor 40 rotates about the center axis in a direction opposite to the above-mentioned direction, referring to FIG. 26E, that is, the direction in which the speed reducing cam face 37 of the main rotor 30 and the second speed reducing cam receiving surface 44 of the speed reducing rotor 40 intermesh.

If the operating part 20 is further pushed from this state, the back end parts of the vertical wall surfaces 35 of the cam receiving surface 33 of the internal cam 32 ride over the front end parts of the projecting parts 12 of the external cam 11 in the front-back direction. At this time, the slanted surfaces 34 of the cam receiving surface 33 of the main rotor 30 and the slanted surfaces 13 of the external cam 11 match and the restriction on the rotation of the main rotor 30 about the center axis by the vertical wall surfaces 14 of the projecting parts 12 of the external cam 11 is released.

If releasing the pushing action of the operating part 20 from the state of FIG. 27C, the operating part 20, main rotor 30, and speed reducing rotor 40 retract due to the biasing force of the spring 6. At this time, the rotation of the main rotor 30 about the center axis is not restricted by the vertical wall surfaces 14 of the projecting parts 12 of the external cam 11. For that reason, the biasing force of the spring 6 through the refill 5 and speed reducing rotor 40 causes the slanted surfaces 34 of the cam receiving surface 33 of the main rotor 30 to push against the slanted surfaces 13 of the external cam 11 or the V-shaped cam faces 25 of the operating part 20 and causes the main rotor 30 to receive the force component of the circumferential direction to rotate about the center axis (counterclockwise when viewing the knock type writing instrument 1 from the front). That is, the internal cam 32 of the main rotor 30 moves along the slanted surfaces of the slanted surfaces 13 of the external cam 11. As a result, the internal cam 32 of the main rotor 30 engages with the external cam 11, and due to this, the writing state is maintained (FIG. 27D). Note that, the operating part 20 retracts due to the biasing force of the biasing spring 7 and is reset to its original position (FIG. 27E).

In the above-mentioned embodiment, there were a combination of the mutually cooperating external cam and the first speed reducing cam receiving surface of the speed reducing rotor and a combination of the mutually cooperating speed reducing cam face of the main rotor and second speed reducing cam receiving surface of the speed reducing rotor, but it is also possible to use just one combination among them. Further, the corresponding shapes of the external cam and the first speed reducing cam receiving surface of the speed reducing rotor and the corresponding shapes of the speed reducing cam face of the main rotor and second speed reducing cam receiving surface of the speed reducing rotor can be freely employed so long as they cooperate with each other to make the speed reducing rotor rotate during movement of the refill backward.

Furthermore, the configuration according to the above-mentioned embodiment can also be applied to another type of knock type writing instrument. For example, the above-mentioned main rotor is switched between the writing state and the nonwriting state by engaging with or disengaging from an external cam provided at the barrel, but it may also be switched by engaging with or disengaging from an external cam provided at a separate member attached to the barrel. Further, the above-mentioned engaging member of the main rotor rotated in accordance with the knock operation, but instead of this it is also possible to use a not rotating engaging member to engage with or disengage from the external cam provided at the barrel to switch between the writing state and nonwriting state. Summarizing this, this can also be applied to a knock type writing instrument which is switched between the writing state and nonwriting state by an engaging member engaging with or disengaging from an external cam provided at the barrel side. Furthermore, this can also be applied to a knock type writing instrument which is switched to the nonwriting state by pushing against a release part separate from the operating part. As a separate release part, for example, a release button may be provided at the outer circumferential surface of the barrel.

Furthermore, in the above-mentioned embodiment, the speed reducing rotor is made to cooperate with the external cam as the first cam face to make it rotate about the center axis. That is, the engaging part engaging with or disengaging from the main rotor and the first cam face making the speed reducing rotor rotate were the same, but they may also be provided as separate members. In this case, one or both of the engaging part and first cam face may be provided at the barrel side, that is, the inner surface of the barrel, or may be provided at separate members attached to the barrel.

In summary, according to the knock type writing instrument 1, a barrel 2, a refill 5 arranged inside the barrel 2, a spring 6 biasing the refill 5 backward, an operating part 20 pushed forward against the biasing force of the spring 6 at the time of a knock operation, and an engaging member are provided. By the engaging member engaging with or disengaging from an engaging part provided at the barrel 2 side, the writing state and the nonwriting state are switched. A speed reducing rotor 40 moving in the front-back direction together with the refill 5 and a first cam face cooperating with the speed reducing rotor 40 and making the speed reducing rotor 40 rotate about its center axis during movement of the refill 5 backward are further provided.

The engaging member may also be made to rotate about the center axis in accordance with a knock operation so as to switch between the writing state and the nonwriting state. The first cam face may also be made to be formed at the inner surface of the barrel 2 side, the speed reducing rotor 40 made to have a first cam receiving surface cooperating with the first cam face, and the first cam receiving surface made to act with the first cam face during movement of the refill 5 backward so that the speed reducing rotor 40 moves backward while engaged in rotary motion. The engaging member may also be made to have a second cam face, the speed reducing rotor 40 made to have a second cam receiving surface cooperating with the second cam face, and the second cam receiving surface made to slide with respect to the second cam face while the refill 5 is moving backward. The first cam receiving surface and the corresponding second cam receiving surface may also have slanted surfaces slanted in opposite directions from each other. The rotation of the speed reducing rotor 40 may also be made to stop due to impact with a restricting surface provided at the inner surface of the barrel 2 side. The first cam face and the engaging part may also be the same. The space closed by the engaging member and the speed reducing rotor 40 may be defined and the volume of the space made to change during movement of the refill 5 backward.

By the knock type writing instrument 1 having the knock lock member 50, in the writing state and the state where the front end is turned upward, movement of the operating part 20 forward is inhibited and a knock operation is not possible. Therefore, at the time of erasing writing by the knock type writing instrument 1 using the erasing member 70, it becomes possible to perform a stable rubbing operation. That is, even if shifting the knock type writing instrument 1 and pushing the erasing member 70 against the written surface to perform a rubbing operation, the erasing member 70 will not become loose.

The knock lock member 50 may be any shape so long as able to move through the inside of the barrel 2 in the front-back direction due to gravity. The number of the first projecting parts 52 of the knock lock member 50 and the number of the corresponding second projecting parts 61 of the locking part 60 may be the same or may be different and may be set in any way. There may be one each or may be a plurality of two or more. Further, the shapes of part of the first projecting parts 52 of the knock lock member 50 and the corresponding recessed parts of the second projecting parts 61 of the locking part 60 need not be complementary, and any shapes can be employed so long as they can lock with each other. Further, the locking part 60, that is, the second projecting parts 61, need only be provided at the barrel 2 side. Therefore, it may be provided at the inner surface of the barrel 2 and may be provided at a separate member attached to the barrel 2.

If summarizing the above for the knock lock member 50, according to the knock type writing instrument 1, there is provided a knock type writing instrument comprising a barrel, a writing member arranged inside the barrel, an elastic member biasing the writing member backward, an operating part which is pushed forward against a biasing force of the elastic member at the time of a knock operation, and an engaging member and performing a knock operation enabling a writing state and a nonwriting state to be switched, which knock type writing instrument further comprises a knock lock member able to move inside the barrel in a front-back direction by gravity and a locking part provided at the barrel side and able to lock with the knock lock member, when a front end of the barrel is turned upward, the knock lock member moving backward to lock with the locking part whereby movement of the operating part forward is obstructed.

The knock lock member 50 may also be a tubular member. The operating part 20 has a lock cam face 22 facing the knock lock member 50, while the knock lock member 50 has a lock cam receiving surface 51 cooperating with the lock cam face 22. The lock cam face 22 and the lock cam receiving surface 51 may also cooperate to make the knock lock member 50 rotate about the center axis if the knock lock member 50 moves backward, thereby the knock lock member 50 and the locking part 60 may become locked. The operating part 20 may also have a lock cam face 22 facing the knock lock member 50, while the main rotor 30 may be arranged inside the operating part 20. The knock lock member 50 has first projecting parts 52, while the locking part 60 has the second projecting parts 61. It is also possible to make it so that if the knock lock member 50 rotates about the center axis, the first projecting parts 52 and the second projecting parts 61 lock and thereby the knock lock member 50 and locking part 60 become locked. All or part of the operating part 20 may be an erasing member 70 able to erase writing by the knock type writing instrument 1. At the side surfaces of the first projecting parts 52 or the second projecting parts 61, recessed parts are formed. It is also possible to use the recessed parts to lock the first projecting parts 52 and the second projecting parts 61. The plurality of the first projecting parts 52 and the plurality of the second projecting parts 61 are respectively arranged at equal intervals along the circumferential direction. Between the projecting parts of one of the first projecting parts 52 or the second projecting parts 61, guide grooves extending in the front-back direction are defined. The other of the projecting parts may be made to move inside the guide groove according to the movement of the knock lock member 50 in the front-back direction. The recessed parts may have slanted surfaces guiding the locking projecting parts to the inside of the guide grooves.

Figure 28:
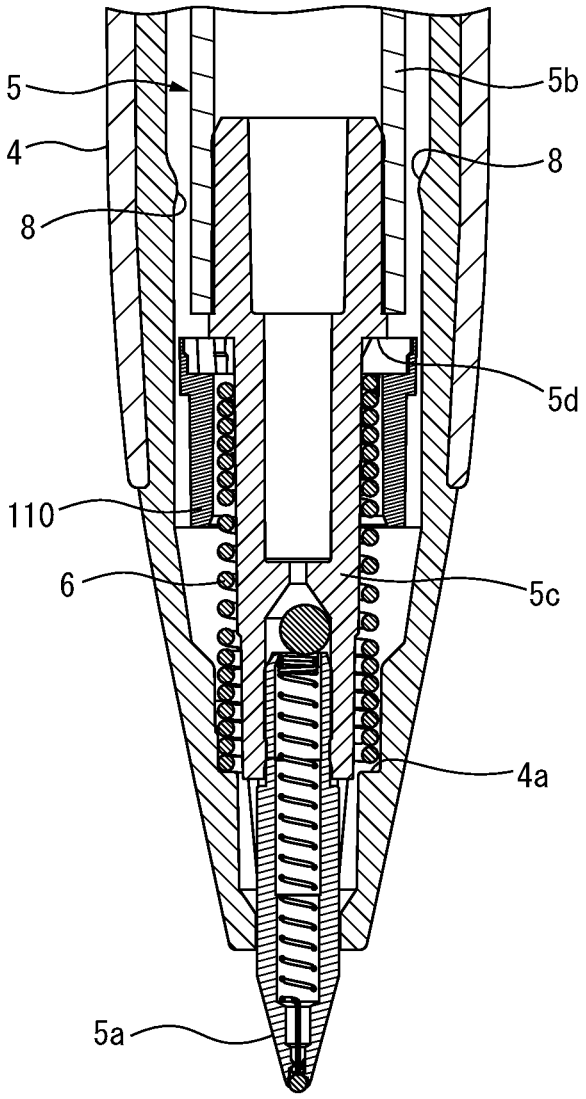
FIG. 28 is an enlarged cross-sectional view of a front end part of the knock type writing instrument of FIG. 1 in the writing state.
Figure 29:
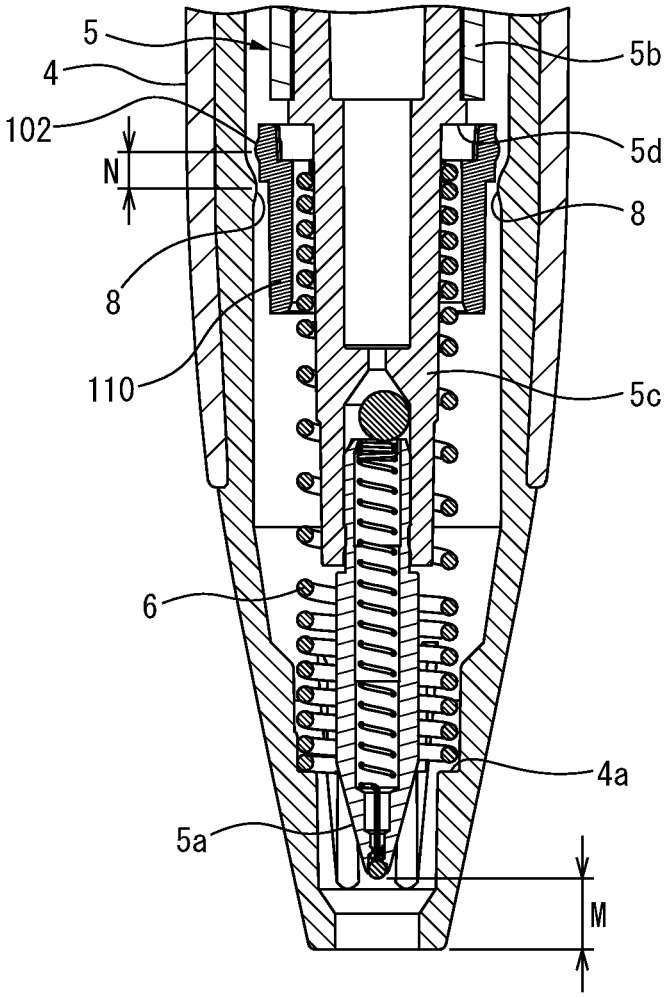
FIG. 29 is an enlarged cross-sectional view of a front end part of the knock type writing instrument of FIG. 1 in the nonwriting state.

FIG. 28 is an enlarged cross-sectional view of the front end part in the writing state of the knock type writing instrument 1, while FIG. 29 is an enlarged cross-sectional view of the front end part in the nonwriting state of the knock type writing instrument 1. The refill 5 has the above-mentioned writing part 5*a*, tubular refill body 5*b*, and joint member 5*c* connecting the writing part 5*a* and tubular refill body 5*b*. At the tip part of the refill 5, that is, the outer circumferential surface of the joint member 5*c*, as a braking part, the cylindrical member of the braking member 110 is provided.

Figure 30:
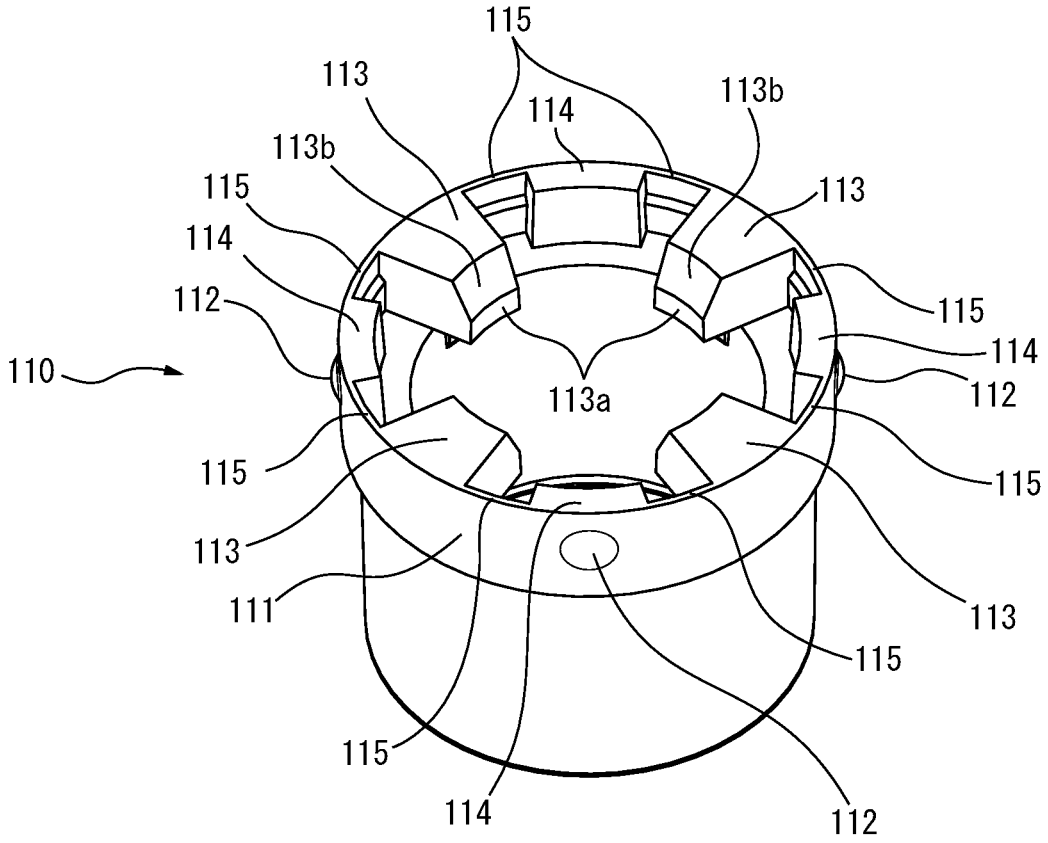
FIG. 30 is a perspective view of a braking member of the knock type writing instrument of FIG. 1.
Figure 31:
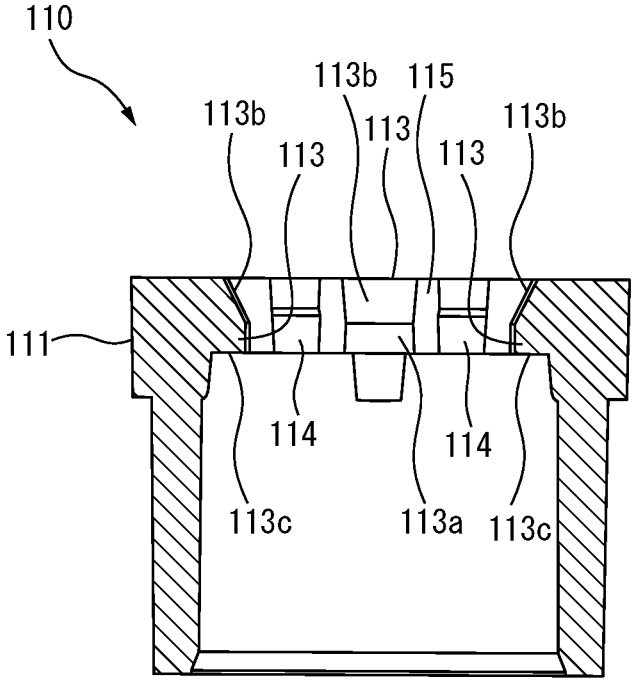
FIG. 31 is a longitudinal cross-sectional view of the braking member of the knock type writing instrument of FIG. 1.

FIG. 30 is a perspective view of the braking member 110 of the knock type writing instrument 1, while FIG. 31 is a longitudinal cross-sectional view of the braking member 110 of the knock type writing instrument 1. In FIG. 30 and FIG. 31, the lower part is the front side of the knock type writing instrument 1. The braking member 110 is provided with respect to the refill 5 so that in FIG. 31, the lower part is the front side of the knock type writing instrument 1 and the upper part is the back side of the knock type writing instrument 1.

At the back end part of the outer circumferential surface of the braking member 110, a ring-shaped flange part 111 is formed. At the outer circumferential surface of the flange part 111, four projections 112 are formed arranged equally along the circumferential direction. Further, at the inner circumferential surface of the flange part 111, four ribs 113 are formed projecting inward in the radial direction and arranged equally along the circumferential direction. At the back end part of the braking member 110, that is, near the flange part 111, thin parts 114 thinner compared with the ribs 113 and connecting parts 115 connecting the ribs 113 and thin parts 114 are formed. Further, projections 112 are formed at the outer circumferential surface of the flange part 111 corresponding to the thin parts 114.

The ribs 113 have holding surfaces 113*a* configured so as to guide the refill 5 inserted or press fit from the back end opening of the braking member 110. Further, at the parts of the ribs 113 near the back end opening of the braking member 110, guide surfaces 113*b* are formed slanted with respect to the center axis. At the time of insertion of the refill 5, the guide surfaces 113*b* guide the writing part 5*a* of the refill 5. The front end surfaces of the ribs 113 are formed with spring supporting surfaces 113*c* vertical to the center axis.

The flange part 111 has flexibility with respect to force in the radial direction due to the thin parts 114 and connecting parts 115 being formed. Therefore, when providing the refill 5 at the braking member 110, the thin parts 114 and connecting parts 115 elastically deform and expand outward in the radial direction so that the ribs 113 firmly hold the refill 5. Further, as explained later, when the braking member 110 brakes the refill 5, the projections 112 can move inward in the radial direction along with elastic deformation of the thin parts 114 and connecting parts 115.

Referring again to FIG. 28 and FIG. 29, the braking member 110 will be explained in greater detail. The braking member 110 is provided at a position where its back end surface abuts against a step part 5*d* of the joint member 5*c* of the refill 5. The front end of the spring 6 is supported by the step part 4*a* formed at the inside surface of the back barrel 4, while the back end of the spring 6 is supported by the spring supporting surface 113*c* of the braking member 110. That is, the refill 5 is biased to the back by the spring 6 through the braking member 110. At the inner circumferential surface of the barrel 2, that is, the back barrel 4, a ring-shaped projection 8 is formed as an abutting part abutting against the projections 112 of the braking member 110.

In the writing state of the knock type writing instrument 1 shown in FIG. 28, if performing a knock operation pressing against the operating part 20, the biasing force of the spring 6 causes the refill 5 to strongly move to the back. At the time of retraction of such a refill 5, the projections 112 of the braking member 110 and the ring-shaped projection 8 of the barrel 2 abut against each other. In other words, the position of the ring-shaped projection 8 of the barrel 2 in the axial direction is set and the size of the projections 112 of the braking member 110 or the ring-shaped projection 8 of the barrel 2 is set so that the projections 112 of the braking member 110 and the ring-shaped projection 8 of the barrel 2 abut when the refill 5 is retracted.

If the projections 112 of the braking member 110 and the ring-shaped projection 8 of the barrel 2 abut, due to the shapes of the projections 112 and the ring-shaped projection 8, that is, the curved shapes, force inward in the radial direction is applied to the projections 112 of the braking member 110. At this time, by the thin parts 114 and connecting parts 115 of the braking member 110 elastically deforming corresponding to the retraction of the refill 5, the projections 112 of the braking member 110 move backward sliding and riding over the ring-shaped projection 8 of the barrel 2. The resistance force, that is, the frictional force, due to sliding of the projections 112 of the braking member 110 with respect to the ring-shaped projection 8 of the barrel 2 slows the retraction of the refill 5. As a result, the kinetic energy of the refill 5 is decreased and finally the impact received by the refill 5 is eased. Accordingly, the occurrence of problems such as poor writing performance due to impact can be kept to a minimum.

The spring characteristic and arrangement of the spring 6 are selected to bias the refill 5 against the above-mentioned frictional force and enable the knock type writing instrument 1 to be switched from the writing state to the nonwriting state.

In the nonwriting state of the knock type writing instrument 1, if the distance between the front end surface of the barrel 2 and the front end of the writing part 5*a* in the axial direction is "M" and the distance between the projections 112 of the braking member 110 and the ring-shaped projection 8 of the barrel 2 in the axial direction is "N", preferably M>N. Conversely, in the case of M<N, if, at the time of retraction of the refill 5, the projections 112 of the braking member 110 cannot ride over the ring-shaped projection 8 of the barrel 2 and the refill 5 ends up stopping, the writing part 5*a* will be exposed from the barrel 2. As a result, if placing the knock type writing instrument 1 in one's pocket etc., one's clothing is liable to end up being stained, so this is not preferable. Therefore, M>N is preferable.

The above-mentioned braking member is, for example, formed from polyacetal or another plastic material. Further, the braking member is separate from the refill 5, so it becomes possible to apply the braking member to an existing refill. However, the braking member may also be formed integrally with the refill.

The braking member or the barrel 2 may be configured in any way so long as cooperating with each other. For example, there may be one, three, or five or more projections 112 of the braking member. The ring-shaped projection 8 provided at the barrel 2 need not be a ring-shaped projection so long as abutting against the projections of the braking member and need not be a projection. For example, it is also possible to gradually reduce the inside diameter of the barrel 2 backward and make the inner circumferential surface of the barrel 2 abut against the projections of the braking member at the time of retraction of the refill 5. Furthermore, at this time, the braking member need not have projections. It is also possible to make the outer surface abut against the inner circumferential surface with the smaller inside diameter.

In summary, the knock type writing instrument 1 is provided with a barrel, a writing member arranged inside the barrel, an elastic member biasing the writing member backward, and an operating part pushed forward against the biasing force of the elastic member at the time of a knock operation. At the outer surface of the writing member, a braking part cooperating with the barrel to brake the writing member at the time of retraction of the writing member due to a knock operation is provided.

Further, the braking part may also have projections. Further, the inner circumferential surface of the barrel may have an abutting part abutting against the projections. Further, the abutting part may also be a projection formed in a ring shape at the inner circumferential surface of the barrel. Further, the braking part may also be a separate cylindrical member able to be detachably attached to the writing member. Further, at the inner circumferential surface of the cylindrical member, a plurality of ribs holding the writing member may be formed.

According to the braking member 110, due to a simple mechanism, it is possible to ease the impact applied to the refill when switching to the nonwriting state.

Figure 32:
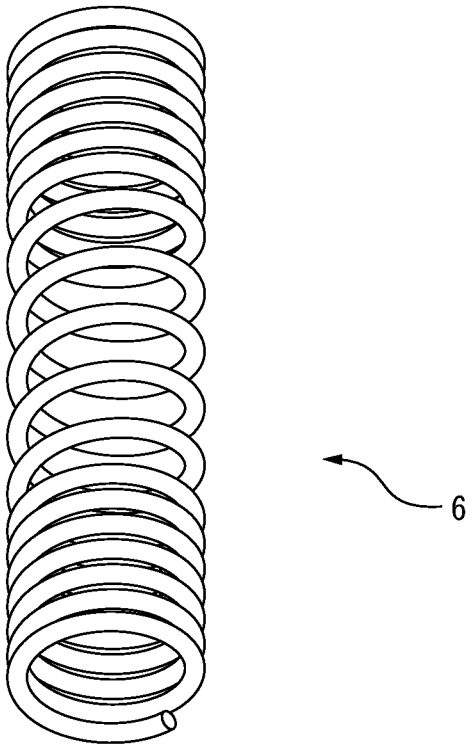
FIG. 32 is a perspective view of a spring of the knock type writing instrument of FIG. 1.
Figure 33:
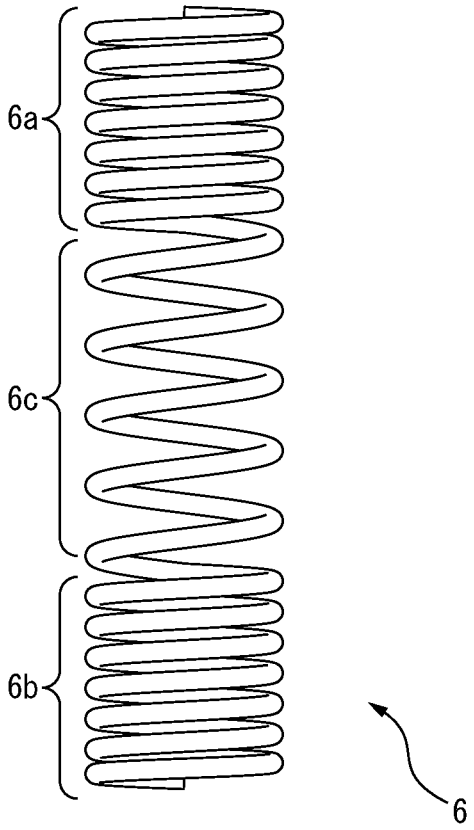
FIG. 33 is a side view of the spring of the knock type writing instrument of FIG. 1.

FIG. 32 is a perspective view of the spring 6 of the knock type writing instrument 1, while FIG. 33 is a side view of the spring 6 of the knock type writing instrument 1. The spring 6 is an uneven pitch coil spring in which the pitch is not uniform over the long direction, and, as shown in FIG. 33, the pitches of the two end parts are formed narrower than the pitch of the center part. That is, the spring 6 has narrow pitch parts 6*a* and 6*b* arranged at its two ends and a broader pitch part 6*c* arranged at its center. The pitches of the narrow pitch part 6*a* and part 6*b* may be the same or may be different.

The spring 6 is formed narrower in pitch at the two end parts than the pitch of the center part, so it is also possible to arrange either of the narrow pitch parts 6*a* and 6*b* at the back end side. That is, when the user replaces the refill 5, it is possible to perform the replacement work without being concerned about the direction of the spring 6.

An uneven pitch coil spring has a different spring characteristic compared with a uniform pitch spring. This will be explained while referring to FIG. 34. Note that, the size of the wire material forming the spring 6 is uniform.

Figure 34:
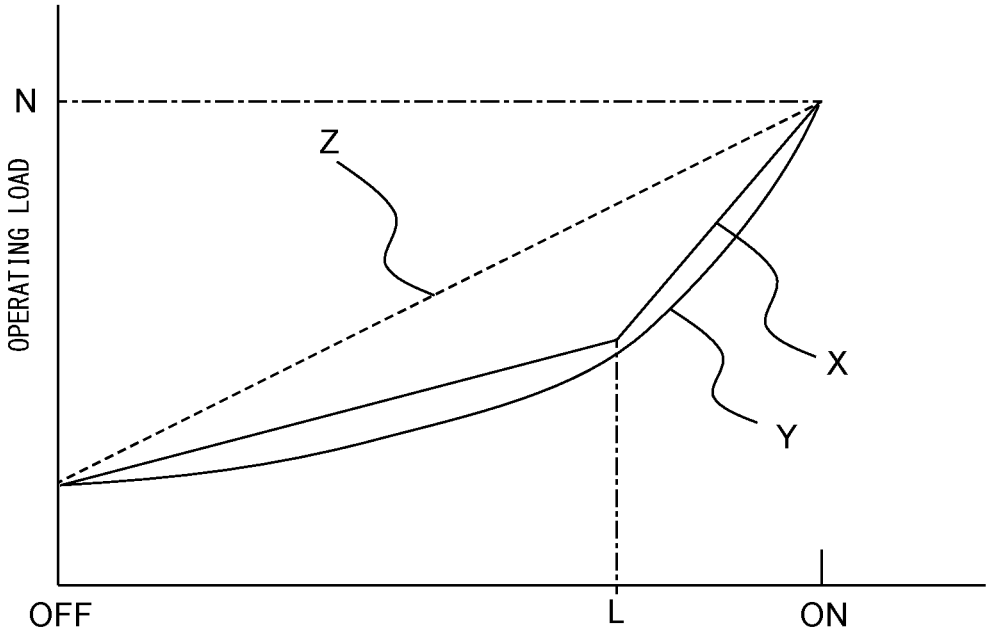
FIG. 34 is a conceptual view showing a relationship of a knock operation and an operating load of the operating part.

FIG. 34 is a conceptual view showing the relationship between a knock operation and the operating load of the operating part. The abscissa shows the position of the operating part in the front-back direction. "OFF" is the position in the nonwriting state, while "ON" is the position in the writing state. The ordinate is the operating load of the operating part corresponding to the position of the operating part in the front-back direction. To change the writing instrument from the writing state to the nonwriting state, a force of a minimum N (N) is required. The solid line X shows the relationship of the knock type writing instrument 1 using a spring 6, while the broken line Z shows the relationship of a conventional writing instrument using a spring with a uniform pitch.

Referring to the broken line Z showing a conventional writing instrument, the position of the operating part and the operating load are in a substantially proportional relationship. As opposed to this, if referring to the solid line X showing the knock type writing instrument 1 having a spring 6, the narrower pitch parts 6*a* and 6*b* are mainly compressed until the position of the operating part reaches L. Therefore, the graph up to the position L is reached is substantially a proportional relationship. On the other hand, after the position L is reached, the broader pitch part 6*c* starts to be compressed, so a substantially proportional relationship with a larger slant is exhibited. That is, due to the uneven pitch coil spring of the spring 6, when switching from the nonwriting state to the writing state of the knock type writing instrument 1, the operating load of the knock operation is not proportional to the amount of movement of the operating part overall, that is, is nonlinear. There is an inflection point.

Here, if setting the operating load N required for switching from the nonwriting state to the writing state of the knock type writing instrument 1 larger than a conventional writing instrument, the writing part is prevented from unintentionally projecting out from the front end of the barrel and ending up staining the pocket of one's clothing. On the other hand, as explained above, there was a problem due to impact occurring at the time of switching from the writing state to the nonwriting state. The size of this impact is greatly related to the spring constant approximated at the position right before the refill 5 stops after the biasing force of the spring 6 causes it to strongly move backward. The smaller the spring constant approximated at this position, the smaller the above-mentioned impact can be kept to. In other words, the smaller the spring constant right after the spring 6 starts to be compressed compared with the spring constant of a spring with uniform pitch, the smaller the above-mentioned impact can be kept to.

For example, in FIG. 34, the slant near the "OFF" position at the solid line X showing the knock type writing instrument 1 having the spring 6 is smaller than the slant of the broken line Z showing a conventional writing instrument using a spring of a uniform pitch. As a result, when switching from the writing state to the nonwriting state, the effect is exhibited that it is possible to keep the impact applied to the refill down to a minimum extent.

Such an advantageous effect is obtained by replacing the elastic member biasing the refill backward, for example, the coil spring with an elastic member having a similar nonlinear spring characteristic, so for example can be applied to all sorts of knock type writing instruments such as a duel writing instrument holding a plurality of refills in the barrel or a writing instrument with an operating part arranged at other than the back end part of the barrel.

Summarizing the above, the coil spring is characterized in that at least one of the pitch, outside diameter, and wire size is not uniform. The coil spring can be set to any shape so long as having the above-mentioned spring characteristic.

In the above-mentioned embodiment, as the member biasing the refill 5 backward, a coil spring was used, but another elastic member having a characteristic shown by the solid line X or solid line Y of FIG. 34 may also be used. For example, an accordion type elastic member or plate shaped elastic member may be used.

In summary, the knock type writing instrument 1 is provided with a barrel, a writing member arranged inside the barrel, an elastic member biasing the writing member backward, and an operating part for performing a knock operation pushing the writing member forward against the biasing force of the elastic member. In the switching from the nonwriting state to the writing state, the operating load of the knock operation is not proportional to the amount of movement of the operating part.

The refill 5 in the above-mentioned embodiment may hold a thermochromic ink containing thermochromic coloring matter. In this case, the knock type writing instrument is a knock type thermochromic writing instrument. The heat of friction generated when using the erasing member constituted by the rubbing member to rub against the surface, writing of the knock type writing instrument can be changed in color by heat.

Here, a "thermochromic ink" means an ink having the property of maintaining a predetermined color (first color) at ordinary temperature (for example 25° C.), changing to a separate color (second color) if raised to a predetermined temperature (for example 60° C.), then again returning to the original color (first color) if made to cool to a predetermined temperature (for example −5° C.). In the knock type writing instrument 1 using a thermochromic ink, making the second color a colorless one and raising the temperature of a line drawn in the first color (for example, red) to render it colorless will be referred to here as "erasing". Therefore, surface on which lines are drawn etc. is rubbed by the rubbing member to generate heat of friction, whereby lines are changed to colorless ones, that is, are erased. Note that, only naturally, the above second color may also be a color rather than be colorless.

The thermochromic microcapsule pigment forming the thermochromic coloring matter is not particularly limited so long as one which changes color due to the heat of the heat of friction etc., for example, one which has the function of changing from a color to colorless, from colored to colored, from colorless to colored, etc. Various ones can be used. A thermochromic composition containing at least a leuco dye, developer, and color changing temperature adjuster formed into microcapsules may be mentioned.

The leuco dye able to be used is not particularly limited so long as an electron donor dye functioning as a color forming agent. Specifically, from the viewpoint of obtaining ink excellent in color forming characteristics, a triphenyl methane type, spiropyran type, fluoran type, diphenylmethane type, rhodamine lactam type, indolyl phthalide type, leuco auramine type, or other conventionally known type independently (one type) or as a mixture of two types or more (below, simply referred to as "at least one type") can be used.

Specifically, 6-(dimethylamino)-3,3-bis[4-(dimethylamino)phenyl]-1(3H)-isobenzofuranon, 3,3-bis(p-dimethylaminophenyl)-6-dimethylaminophthalide, 3-(4-diethylaminophenyl)-3-(1-ethyl-2-methylindol-3-yl)phthalide, 3-(4-diethylamino-2-ethoxyphenyl)-3-(1-ethyl-2-methylindol-3-yl)-4-azaphthalide, 1,3-dimethyl-6-diethylaminofluoran, 2-chloro-3-methyl-6-dimethylaminofluoran, 3-dibutylamino-6-methyl-7-anilinofluoran, 3-diethylamino-6-methyl-7-anilinofluoran, 3-diethylamino-6-methyl-7-xylidinofluoran, 2-(2-chloroanilino)-6-dibutylaminofluoran, 3,6-dimethoxyfluoran, 3,6-di-n-butoxyfluoran, 1,2-benz-6-diethylaminofluoran, 1,2-benz-6-dibutylaminofluoran, 1,2-benz-6-ethylisoamylaminofluoran, 2-methyl-6-(N-p-tolyl-N-ethylamino)fluoran, 2-(N-phenyl-N-methylamino)-6-(N-p-tolyl-N-ethylamino)fluoran, 2-(3'-trifluoromethylanilino)-6-diethylaminofluoran, 3-chloro-6-cyclohexylaminofluoran, 2-methyl-6-cyclohexylaminofluoran, 3-di(n-butyl)amino-6-methoxy-7-anilinofluoran, 3,6-bis(diphenylamino)fluoran, methyl-3',6'-bisdiphenylaminofluoran, chloro-3',6'-bisdiphenylaminofluoran, 3-methoxy-4-dodecoxystyrylquinoline, etc. may be mentioned.

These leuco dyes are ones having a lactone skeleton, pyridine skeleton, quinazoline skeleton, bisquinazoline skeleton, etc. These skeletons (rings) form color by ring opening.

The developer able to be used is an ingredient which has the ability to make the above leuco dye form color. For example, a phenol resin-based compound, salicylic acid-based metal salt compound, salicylic acid resin-based metal salt compound, solid acid-based compound, etc. may be mentioned.

Specifically, at least one of o-cresol, tertiary butylcatechol, nonylphenol, n-octylphenol, n-dodecylphenol, n-stearylphenol, p-chlorophenol, p-bromophenol, o-phenylphenol, hexafluorobisphenol, n-butyl p-hydroxybenzoate, n-octyl p-hydroxybenzoate, resorcine, dodecyl gallate, 2,2-bis(4'-hydroxyphenyl)propane, 4,4-dihydroxydiphenylsulfone, 1,1-bis(4'-hydroxyphenyl)ethane, 2,2-bis(4'-hydroxy-3-methylphenyl)propane, bis(4-hydroxyphenyl)sulfide, 1-phenyl-1,1-bis(4'-hydroxyphenyl)ethane, 1,1-bis(4'-hydroxyphenyl)-3-methylbutane, 1,1-bis(4'-hydroxyphenyl)-2-methylpropane, 1,1-bis(4'-hydroxyphenyl)n-hexane, 1,1-bis(4'-hydroxyphenyl)n-heptane, 1,1-bis(4'-hydroxyphenyl)n-octane, 1,1-bis(4'-hydroxyphenyl)n-nonane, 1,1-bis(4'-hydroxyphenyl)n-decane, 1,1-bis(4'-hydroxyphenyl)n-dodecane, 2,2-bis(4'-hydroxyphenyl)butane, 2,2-bis(4'-hydroxyphenyl)ethylpropionate, 2,2-bis(4'-hydroxyphenyl)-4-methylpentane, 2,2-bis(4'-hydroxyphenyl)hexafluoropropane, 2,2-bis(4'-hydroxyphenyl)n-heptane, 2,2-bis(4'-hydroxyphenyl)n-nonane, etc. may be mentioned.

The amount of use of the developer used may be suitably selected in accordance with the desired color density and is not particularly limited, but usually is suitably selected in the range of 0.1 to 100 parts by mass or so with respect to 1 part by mass of the above-mentioned leuco dye.

The color changing temperature adjuster which can be used is a substance controlling the color changing temperature in color formation by the leuco dye and developer. As the color changing temperature adjuster which can be used, a conventionally known one can be used. Specifically, alcohols, esters, ketones, ethers, acid amides, azomethines, fatty acids, hydrocarbons, etc. may be mentioned.

More specifically, at least one of bis(4-hydroxyphenyl)phenylmethane dicaprylate ($C_7H_{15}$), bis(4-hydroxyphenyl)phenylmethanedilaurate ($C_{11}H_{23}$), bis(4-hydroxyphenyl)phenylmethanedimyristate ($C_{13}H_{27}$), bis(4-hydroxyphenyl)phenylethanedimyristate ($C_{13}H_{27}$), bis(4-hydroxyphenyl)phenylmethanedipalmitate ($C_{15}H_{30}$), bis(4-hydroxyphenyl)phenylmethanedibehenate ($C_{21}H_{43}$), bis(4-hydroxyphenyl)phenylethylhexylidenedimyristate ($C_{13}H_{27}$), etc. may be mentioned.

The amount of use of this color changing temperature adjuster may be suitably selected in accordance with the desired hysteresis width and color density at the time of color formation etc. It is not particularly limited, but usually is preferably used in the range of about 1 to 100 parts by mass or so with respect to 1 part by mass of the leuco dye.

The thermochromic microcapsule pigment can be produced by microencapsulating a thermochromic composition containing at least the above leuco dye, developer, and color changing temperature adjuster so as to give an average particle size of 0.2 to 3 μm. As the microcapsulation method, for example, the interfacial polymerization method, interfacial polycondensation method, in situ polymerization method, liquid curing coating method, phase separation method from an aqueous solution, phase separation method from an organic solvent, melt dispersion cooling method, air suspension coating method, spray drying method, etc. may be mentioned. It can be suitably selected in accordance with the application.

For example, in the method of phase separation from an aqueous solution, the leuco dye, the developer, and the color changing temperature adjuster are heated to melt, then are charged into an emulsifier solution, are heated and stirred to make them disperse in the form of drops of oil, then are gradually charged into for example, using a resin feedstock etc., an amino resin solution, isocyanate-based resin solution, etc., as a capsule membrane agent, then are made to react. After preparation, this dispersion can be filtered to produce the target thermochromic microcapsule pigments.

The contents of these leuco dye, developer, and color changing temperature adjuster vary depending on the types of the leuco dye, developer, and color changing temperature adjuster, microencapsulation method, etc., but are by mass ratio 0.1 to 100 of the developer and 1 to 100 of the color changing temperature adjuster with respect to 1 of the pigment. Further, the capsule membrane agent is contained in a mass ratio of 0.1 to 1 with respect to the capsule contents.

In the thermochromic microcapsule pigment, by suitably combining the types, amounts, etc. of the leuco dye, developer, and color changing temperature adjuster, it is possible to set the color forming temperatures of the different colors (for example, color forming at 0° C. or more) and color erasing temperature (for example, color erased at 50° C. or more) at suitable temperatures. It is preferable to use heat of the heat of friction etc. to change from the colored to colorless state.

In the thermochromic microcapsule pigment, from the viewpoint of further improvement of the line density, storage stability, and writability, the wall membrane is preferably formed by urethane resin, urea/urethane resin, epoxy resin, or amino resin. As a urethane resin, for example, a compound of an isocyanate and polyol may be mentioned. As the epoxy resin, for example, a compound of an epoxy resin and amine may be mentioned. As the amino resin, a melamine resin, urea resin, benzoguanamine resin, etc. may be mentioned. The thickness of the wall membrane of the microcapsule coloring matter is suitably determined according to the required strength of the wall membrane and line density.

The average particle size of the thermochromic microcapsule pigment is preferably 0.2 to 5 μm, more preferably 0.3 to 3 μm from the viewpoints of the coloring ability, color forming ability, ease of erasure, stability, and fluidity in the ink and the viewpoints of suppression of adverse effects on the writability, compatibility with the later explained photochromic microcapsule pigment, etc. Note that, the "average particle size" prescribed here is the value obtained by measuring the average particle size (50% size) (refractive index of 1.8) by a particle size analyzer (Microtrac HRA9320-X100 (made by Nikkiso)).

If this average particle size is less than 0.2 μm, a sufficient line density is not obtained, while if over 5 μm, deterioration of the writability, a drop in the dispersion stability of the thermochromic microcapsule pigment, and ink-back due to vibration easily occur, so this is not preferable. Furthermore, the 90% size is 8 μm or less, preferably 6 μm or less. If large size particles are present in a certain ratio or more, the above-mentioned effects tend to occur more remarkably. Note that, microcapsule pigments with the above-mentioned range of average particle size (0.2 to 5 μm), while varying depending on the microcapsule forming method, can be prepared by the method of phase separation from an aqueous solution by suitably combining the agitation conditions at the time of production of the microcapsule pigment.

The specific gravity of the thermochromic microcapsule pigment is 0.9 to 1.3, preferably 1.0 to 1.2 in range. If the specific gravity is outside this range, the dispersion stability of the microcapsule pigment easily falls. Further, with microcapsule pigments with specific gravities over 1.3, ink-back easily occurs due to vibration.

In the water-based ink composition for writing instrument use, in addition to the thermochromic microcapsule pigments, a balance of water as a solvent (tap water, purified water, distilled water, ion exchanged water, pure water, etc.) plus, in accordance with the applications for writing instrument use (ballpoint pen use, marking pen use, etc.), to a range not detracting from the results, a water soluble organic solvent, thickener, lubricant, rust inhibitor, preservative or antifungal agent, etc. may be suitably contained.

As the water-based organic solvent able to be used, for example, ethylene glycol, diethylene glycol, triethylene glycol, propylene glycol, polyethylene glycol, 3-butylene glycol, thiodiethylene glycol, glycerin, and other glycols or ethylene glycol monomethyl ether and diethylene glycol monomethyl ether can be used alone or mixed.

Among these, for the purpose of suppressing solidification of ink at the writing part due to ink-back, glycerin is preferably used. The amount of addition is preferably 1 to 10 mass % with respect to the total amount of ink. The mechanism of action due to the glycerin is not clear, but it is believed that there is the effect of causing a reduction in the agglomerating force of the pigment and ink ingredients in the dried state.

As the thickener which can be used, for example, at least one type selected from the group comprised of synthetic polymers, cellulose, and polysaccharides is preferable. Specifically, gum arabic, tragacanth gum, guar gum, locust bean gum, alginic acid, carrageenan, gelatin, xanthan gum, welan gum, succinoglycan, diutan gum, dextran, methylcellulose, ethylcellulose, hydroxyethylcellulose, carboxymethylcellulose, starch glycolic acid and its salts, propylene glycol alginate ester, polyvinyl alcohol, polyvinyl pyrrolidone, polyvinyl methyl ether, polyacrylic acid and its salts, carboxyvinyl polymers, polyethylene oxide, copolymers of vinyl acetate and polyvinyl pyrrolidone, cross-linking type acrylic acid polymers and their salts, non-cross-linking type acrylic acid polymers and their salts, styrene-acrylic acid copolymers and their salts, etc. may be mentioned.

Among these, a polysaccharide is preferably used. A polysaccharide tends to be resistant to effects on fluidity due to vibration due to its rheological characteristic. Problems such as poor writing performance due to ink-back hardly ever occur. In particular, xanthan gum is excellent in balance with other characteristics demanded from writing instrument ink and is preferable.

As the lubricant, ones used also as surface treatment agents of pigments such as fatty acid esters of polyhydric alcohol, higher fatty acid esters of sugar, polyoxyalkylene higher fatty acid esters, alkyl phosphate esters, alkyl sulfonates of higher fatty acid amides, alkyl allyl sulfonates, derivatives of polyalkylene glycol and fluorine-based surfactants, polyether-modified silicon, etc. may be mentioned. Further, as the rust inhibitor, benzotriazole, tolyltriazole, dicyclohexylammonium nitrite, saponins, etc. may be mentioned. As the preservative or antifungal agent, phenol, sodium omadine, sodium benzoate, benzimidazole-based compounds, etc. may be mentioned.

To produce this water-soluble ink composition for writing instrument use, a conventionally known method can be employed. For example, this is obtained by blending predetermined amounts of the above thermochromic and photochromic microcapsule pigments plus the above water-based ingredients and stirring and mixing them by a homomixer or disperser or other agitator. Furthermore, in accordance with need, it is possible to remove coarse particles in the ink composition by filtering or centrifugation.

The viscosity value of the water-based ink composition for writing instrument use is preferably, at 25° C., 500 to 2000 mPa·s at a shear rate of 3.83/s and 20 to 100 mPa·s at a shear rate of 383/s. By setting the value to the above viscosity range, it is possible to obtain ink excellent in writability and stability over time. Furthermore, the non-Newtonian viscosity index "n" found by a viscosity formula shown by $S=\alpha D^n$ (where, $1>n>0$) (S is the shear stress ($dyn/cm^2$), D is the shear rate ($s^{-1}$), and $\alpha$ is a non-Newtonian viscosity coefficient) is preferably 0.2 to 0.6. By making the non-Newtonian viscosity index "n" the above range in addition to the above viscosity range and thereby enabling the fluidity of the ink with respect to vibration to be suitably set, it becomes possible to prevent occurrence of ink-back.

The surface tension of the water-based ink composition for writing instrument use is preferably 25 to 45 mN/m, more preferably 30 to 40 mN/m. If in this range, the balance between the inside of the tip and wettability of the ink becomes suitable and occurrence of ink-back can be prevented.

Inside the refill, an ink follower may be arranged right behind the ink. The material forming the follower may be comprised of at least a nonvolatile or a less volatile organic solvent and a thickener. The nonvolatile or the less volatile organic solvent used for the ink follower is used as the base oil of the ink follower. For example, liquid paraffin is used. For the liquid paraffin, mineral oil and a chemical synthetic oil may be used. As the chemical synthetic oil, polybutene, poly α-olefin, ethylene α-olefin oligomer, etc. can be used.

As specific mineral oils able to be used, for example, the commercially available Diana Process Oil NS-100, PW-32, PW-90, NR-68, and AH-58 (made by Idemitsu Kosan) etc. may be mentioned.

As the specific polybutene able to be used, for example, the commercially available Nissan Polybutene 200N, Polybutene 30N, Polybutene 10N, Polybutene 5N, Polybutene 3N, Polybutene 015N, Polybutene 06N, Polybutene 0N (above, made by NOF Corporation), Polybutene HV-15 (made by Nippon Petrochemicals), 35R (made by Idemitsu Kosan), etc. may be mentioned.

As the specific poly α-olefin able to be used, for example, the commercially available Barrel Process Oil P-26, P-46, P-56, P-150, P-350, P-1500, P-2200, (P-10000, P-37500) (made by Matsumura Oil), etc. may be mentioned.

As specific ethylene α-olefin oligomers able to be used, for example, the commercially available Lucant HC-10, HC-20, HC-100, HC-150, (HC-600, HC-2000) (above, made by Mitsui Chemicals) etc. may be mentioned.

These nonvolatile or less volatile organic solvents can be used as single types or two types or more combined.

As the thickener used for an ink follower, for example, a calcium salt of a phosphoric acid ester, particulate silica, polystyrene-polyethylene/butylenes rubber-polystyrene block copolymer, polystyrene-polyethylene/propylene rubber-polystyrene block copolymer, hydrated styrene-butadiene rubber, styrene-ethylenebutylene-olefin crystal block copolymer, olefin crystal-ethylenebutylene-olefin crystal block copolymer, and acetoalkoxyaluminum dialkylate, etc. may be mentioned. These can be used as single types or two types or more.

As preferable commercially available calcium salts of the phosphoric acid ester able to be used, Crodax DP-301LA (made by Croda Japan) etc. may be mentioned. The particulate silica able to be used includes hydrophilic particulate silica and hydrophobic particulate silica. As preferable commercially available hydrophilic silica, AEROSIL-300, AEROSIL-380 (made by Aerosil) etc. may be mentioned, while further as preferable commercially available hydrophobic silica, AEROSIL-974D, AEROSIL-972 (made by Aerosil), etc. may be mentioned.

Further, as preferable commercially available block copolymers of polystyrene-polyethylene/butylenes rubber-polyethylene, Kraton GFG-1901X, Kraton GG-1650 (above, made by Shell Japan), Septon 8007, Septon 8004 (above, made by Kuraray), etc. may be mentioned. Furthermore, as preferable commercially available block copolymers of polystyrene-polyethylene/polypropylene rubber-polyethylene, Kraton GG-1730 (made by Shell Japan), Septon 2006, Septon 2063 (above, made by Kuraray), etc. may be mentioned.

As preferable commercially available hydrated styrene-butadiene rubber, DYNARON 1320P, DYNARON 1321P (above, made by JSR), TUFTEC H1041, TUFTEC H1141 (above, made by Asahi Kasei), etc. may be mentioned.

As preferable commercially available block copolymers of styrene-ethylenebutylene-olefin crystals, DYNARON 4600P (made by JSR) etc. may be mentioned. As preferable commercially available block copolymers of olefin crystal-ethylenebutylene-olefin crystals, DYNARON 6200P, DYNARON 6201B (made by JSR), etc. may be mentioned.

As a preferable commercially available acetoalkoxyaluminum dialkylate, Plenact AL-M (made by Ajinomoto Fine-Techno), etc. may be mentioned.

Among these thickeners, from the viewpoint of further manifesting the effect of the present invention, a styrene-ethylenebutylene-olefin crystal block copolymer, olefin crystal-ethylenebutylene-olefin crystal block copolymer, or other thermoplastic olefin-based elastomer is preferably used.

In the present invention, furthermore, from the viewpoint of obtaining an ink follower preventing the occurrence of ink-back, it is preferable that the average value of the tan δ value measured every frequency while making the frequency exponentially increase in the frequency region of "1 to 63 rad/s" be 1.0 or more, more preferable that it be 1.7 to 3.4.

Here, the "tan δ" is a value meaning the loss modulus/storage modulus. In the past, it has been known that it is preferable that the average value of the tan δ value measured every frequency while making the frequency exponentially increase in the frequency region of "1 to 63 rad/s" be 1.0 or less. In the present invention, by making the average value of the tan δ value measured every frequency in the above 1 to 63 rad/s 1.0 or more, it becomes possible to absorb the vibration to prevent occurrence of ink-back.

As the material forming the rubbing member, silicone rubber, nitrile rubber, ethylenepropylene rubber, ethylenepropylene-diene rubber, or other thermosetting rubber or styrene-based elastomers, olefin-based elastomers, polyester-based elastomers, or other thermoplastic elastomers or other such rubber elastic materials, mixtures of two types or more of rubber elastic materials, and mixtures of rubber elastic materials and synthetic resins can be used. This is configured so that in an abrasion test prescribed in JIS K7204 (ASTM D1044) under an environment of a load of 9.8N and 1000 rpm, the amount of Taber abrasion at an abrasion ring CS-17 of a Taber abrasion tester becomes 10 mg or more to thereby form a rubbing member. If a rubbing member with an amount of Taber abrasion of less than 10 mg, at the time of rubbing, the paper surface ends up being damaged and printed letters end up being worn down.

To adjust the amount of Taber abrasion to become 10 mg or more, it is also possible to add to the material of the rubbing member something for making it more flexible such as an alkylsulfonic acid phenyl ester, cyclohexanedicarboxylic acid ester, or phthalic acid-based plasticizer. By the rubbing member including an alkylsulfonic acid phenyl ester, cyclohexanedicarboxylic acid ester, or phthalic acid-based plasticizer, the rubbing member becomes more easily abraded, so writing can be erased without the paper surface being damaged and printed letters etc. being worn down. Furthermore, the rubbing member preferably has a durometer D hardness prescribed in JIS K6203 of 30 or more. Due to this, a predetermined hardness can be secured and a more stable rubbing operation becomes possible. Note that, the rubbing member can also be applied to a touch pen or stylus pen.

Further, the rubbing member is preferably colored by a color with a lightness value lower than the color of the thermochromic ink stored in the knock type writing instrument 1. That is, when using the rubbing member, it is possible to keep the transfer of thermochromic ink from being noticeable when thermochromic ink of the knock type writing instrument 1 is transferred to the surface of the rubbing member without changing in color. In particular, by making the color of the rubbing member a black color, it is possible to keep the dirtying of the surface accompanied with use of the rubbing member from being noticeable.

The lightness value is found by using a universal color difference meter (TC-8600A, made by Tokyo Denshoku) or other measuring device and using a Munsell color system. The lightness value of the rubbing member was found by measuring the surface, while the lightness value of the thermochromic ink was found by measuring a line drawn on a paper surface (old JIS P3201; high quality paper made from 100% chemical pulp, basis weight range 40 to 157 $g/m^2$, whiteness 75.0% or more) by a writing speed of 4.5 m/min and a pitch distance of 0.1 mm.

REFERENCE SIGNS LIST

1. knock type writing instrument
2. barrel
3. front barrel
4. back barrel
5. refill
6. spring
7. biasing spring
10. inner tube
13. slanted surface
20. operating part
30. main rotor
40. speed reducing rotor
50. knock lock member
60. locking part
70. erasing member
80. holding member
90. cover member
100. refill cap
110. braking member

The invention claimed is:

1. A knock type writing instrument comprising a barrel, a writing member arranged inside said barrel, an elastic member biasing said writing member backward, an operating part which is pushed forward against a biasing force of said elastic member at the time of a knock operation, and an engaging member performing a knock operation enabling a writing state and a nonwriting state to be switched, which knock type writing instrument further comprises a knock lock member able to move inside said barrel in a front-back direction by gravity and a locking part provided at said barrel side and able to lock with said knock lock member, when a front end of said barrel is turned upward, said knock lock member moving backward to lock with said locking part whereby movement of said operating part forward is obstructed, wherein said knock lock member is formed into a rotationally symmetric tubular shape about a central axis of the knock type writing instrument.

2. The knock type writing instrument according to claim 1, wherein said knock type writing instrument is switched between the writing state and nonwriting state by said engaging member being engaged with or disengaged from an engaging part provided at said barrel side and further comprises a speed reducing rotor moving in a front-back direction together with said writing member and a first cam face making said speed reducing rotor rotate about a center axis in cooperation with said speed reducing rotor while said writing member is moving backward.

3. The knock type writing instrument according to claim 1, wherein an outer surface of said writing member is provided with a braking part braking said writing member in cooperation with said barrel when said writing member is retracted by a knock operation.

4. The knock type writing instrument according to claim 1, wherein said elastic member is a coil spring with at least one of a pitch, outside diameter, and wire size which is not uniform.

5. The knock type writing instrument according to claim 1, wherein said operating part has an erasing member, said erasing member is triangular shaped in transverse cross-section exposed at a back end, a vertex of the triangular shape is formed in a round arc shape, and a radius of curvature of that arc is greater at the back end side.

6. The knock type writing instrument according to claim 1, wherein said knock type writing instrument is a knock type writing instrument having thermochromic ink, said operating part has an erasing member, and heat of friction generated when using said erasing member to rub a surface enabling writing by said thermochromic ink to be changed in color by heat.

7. A knock type writing instrument comprising a barrel, a writing member arranged inside said barrel, an elastic member biasing said writing member backward, an operating part which is pushed forward against a biasing force of said elastic member at the time of a knock operation, an engaging member performing a knock operation enabling a writing state and a nonwriting state to be switched, a speed reducing rotor moving in a front-back direction together with said writing member and a first cam face making said speed reducing rotor rotate about a center axis in cooperation with said speed reducing rotor while said writing member is moving backward, wherein the knock type writing instrument further comprises a knock lock member able to move inside said barrel in a front-back direction by gravity and a locking part provided at said barrel side and able to lock with said knock lock member, when a front end of said barrel is turned upward, said knock lock member moving backward to lock with said locking part whereby movement of said operating part forward is obstructed, and wherein said knock type writing instrument is switched between the writing state and nonwriting state by said engaging member being engaged with or disengaged from an engaging part provided at said barrel side.

* * * * *